US010665931B2

(12) United States Patent
Lier et al.

(10) Patent No.: US 10,665,931 B2
(45) Date of Patent: May 26, 2020

(54) WAVEGUIDE APERTURE DESIGN FOR GEO SATELLITES

(71) Applicant: LOCKHEED MARTIN CORPORATION, Bethesda, MD (US)

(72) Inventors: Erik Lier, Lakewood, CO (US); Jason Stewart Wrigley, Broomfield, CO (US); Arun Kumar Bhattacharyya, Rancho Palos Verdes, CA (US); Timothy Patrick Wink, Castle Rock, CO (US); James F. Mulvey, Castle Pines, CO (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 147 days.

(21) Appl. No.: 16/049,700

(22) Filed: Jul. 30, 2018

(65) Prior Publication Data

US 2019/0044223 A1 Feb. 7, 2019

Related U.S. Application Data

(60) Provisional application No. 62/539,995, filed on Aug. 1, 2017.

(51) Int. Cl.

| | |
|---|---|
| ***H01Q 13/00*** | (2006.01) |
| ***H01Q 1/28*** | (2006.01) |
| ***H01Q 13/02*** | (2006.01) |
| ***H01Q 5/50*** | (2015.01) |
| ***H01Q 1/38*** | (2006.01) |
| ***H01Q 21/22*** | (2006.01) |
| ***H01Q 1/24*** | (2006.01) |
| ***H01Q 21/00*** | (2006.01) |
| ***H01P 1/213*** | (2006.01) |
| ***H01Q 5/55*** | (2015.01) |
| ***H01P 1/17*** | (2006.01) |

(52) U.S. Cl.

CPC ..... *H01Q 1/288* (2013.01); *H01P 1/173* (2013.01); *H01P 1/2138* (2013.01); *H01Q 1/247* (2013.01); *H01Q 1/38* (2013.01); *H01Q 5/50* (2015.01); *H01Q 5/55* (2015.01); *H01Q 13/025* (2013.01); *H01Q 21/0025* (2013.01); *H01Q 21/22* (2013.01)

(58) Field of Classification Search

CPC ..... H01Q 1/288; H01Q 5/55; H01Q 21/0025; H01Q 21/22; H01Q 13/025; H01P 1/2002; H01P 1/207

See application file for complete search history.

(56) References Cited

U.S. PATENT DOCUMENTS

| | | | | |
|---|---|---|---|---|
| 6,201,508 B1 * | 3/2001 | Metzen | H01Q 3/0258 343/776 |
| 2015/0162668 A1 * | 6/2015 | Oppenlaender | H01Q 13/02 343/776 |
| 2016/0218436 A1 * | 7/2016 | Rao | H01Q 21/30 |

* cited by examiner

*Primary Examiner* — Dieu Hien T Duong

(74) *Attorney, Agent, or Firm* — Morgan, Lewis & Bockius LLP

(57) ABSTRACT

An antenna array includes multiple array modules. Each array module includes at least on antenna element including a horn antenna coupled to a polarizer, and a two-piece waveguide filter. The two-piece waveguide filter includes a folded-back waveguide coupled to the horn antenna at one end and to a circuit layer at the other end. The horn antenna includes a multi-mode horn antenna. The two-piece waveguide filter includes a first piece and a second piece that are separately molded. A footprint of the two-piece waveguide filter is within a footprint of an aperture of the horn antenna.

20 Claims, 16 Drawing Sheets

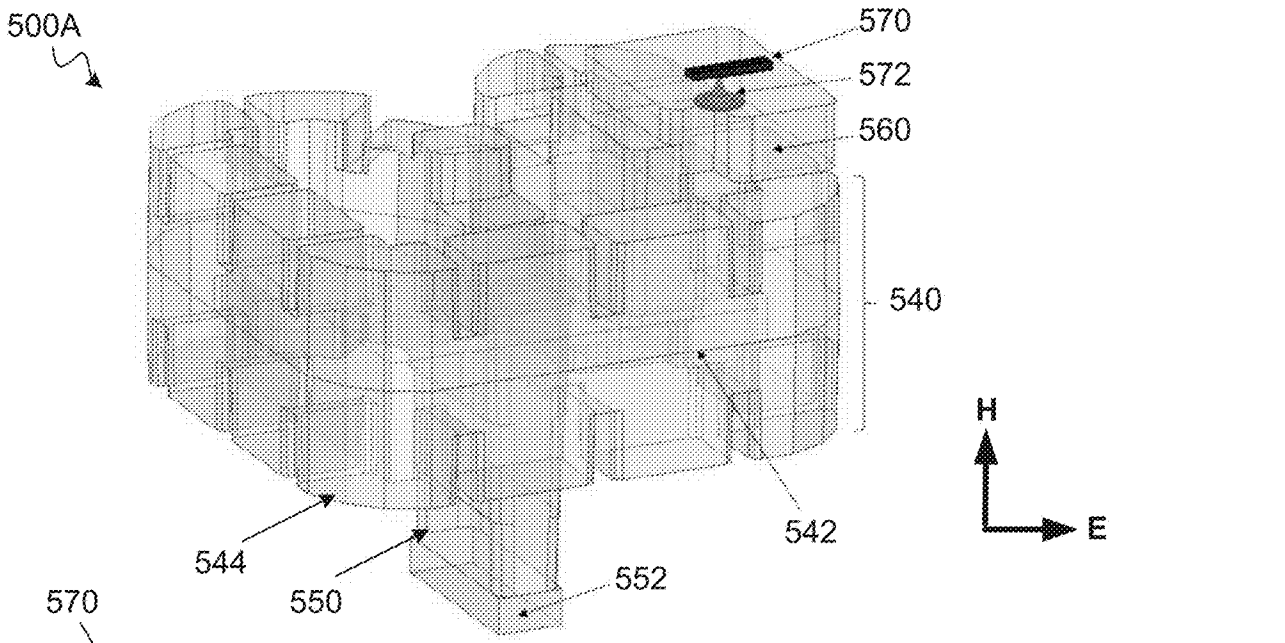
FIG. 5A
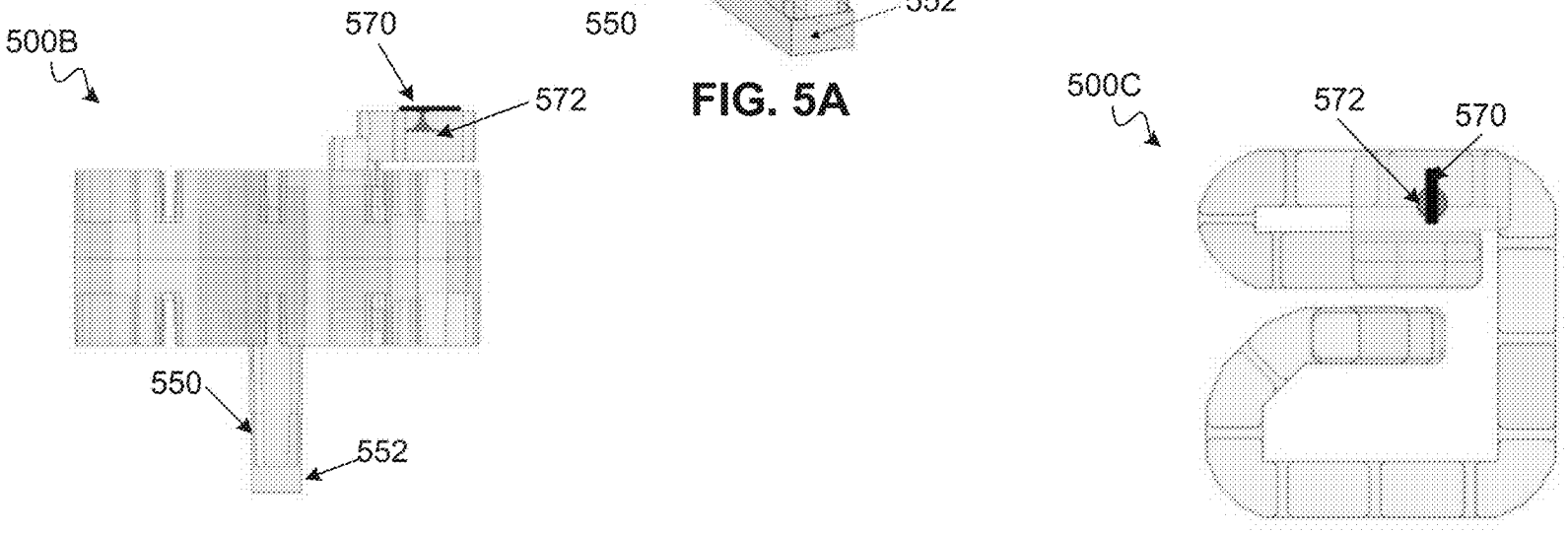
FIG. 5C
FIG. 5B

600B

600A

WAVEGUIDE APERTURE DESIGN FOR GEO SATELLITES

CROSS-REFERENCE TO RELATED APPLICATIONS

This application claims the benefit of priority under 35 U.S.C. § 119 from U.S. Provisional Patent Application 62/539,995 filed Aug. 1, 2017, which is incorporated herein by reference in its entirety.

STATEMENT REGARDING FEDERALLY SPONSORED RESEARCH OR DEVELOPMENT

Not applicable.

FIELD OF THE INVENTION

The present invention generally relates to satellite array antennas, and more particularly, to waveguide aperture design for geostationary earth orbit (GEO) and medium earth orbit (MEO) satellites.

BACKGROUND

Many satellite systems use phased-array antennas for radar, communication and navigation (GPS). These phased-array antennas can be large monolithic antennas having large receiving aperture designed to achieve high gains. Moving target detection requires a high signal-to-noise ratio, which can be achieved by using complex phased-array antennas fed by powerful transmitters. Supporting frames used to hold large numbers of antenna array elements in a well-defined, fixed spatial orientation can be substantially large, which can add to the mass and complexity of such systems and results in larger overall mass of the satellite systems employing phased-array antennas.

Lockheed Martin Proprietary Information

The most common antenna approach includes using a subarray consisting of microstrip patch elements, dipole elements or helix elements. Filters and diplexers are most often done in stripline or microstrip technology. Horns followed by waveguide filters or diplexers are also frequently used, but they are typically arranged to be perpendicular to the radiating aperture, thereby resulting in a long and heavy aperture that is less compliant with low-cost manufacturing.

SUMMARY

According to various aspects of the subject technology, methods and configuration are disclosed for providing active phased arrays for geostationary (GEO) satellites and medium earth orbit (MEO) satellites. In particular, the subject technology relates to antenna aperture design including the design of the antenna elements and filters after the transmit amplifiers such as solid-state power amplifier (SSPAs) for a transmit path, or the antenna elements and filters before the amplifiers such as low-noise amplifiers (LNAs) for a receive path.

In one or more aspects, an antenna array includes multiple array modules. Each array module includes one or more antenna elements, each including a horn antenna coupled to a polarizer, and a two-piece waveguide filter. The two-piece waveguide filter includes a folded-back waveguide coupled to the horn antenna at one end and to a circuit layer at the other end. The horn antenna includes a multi-mode horn antenna. The two-piece waveguide filter includes a first piece and a second piece that are separately molded. A footprint of the two-piece waveguide filter is within a footprint of an aperture of the horn antenna.

In other aspects, an apparatus includes a number of subarrays. Each subarray includes multiple array modules. Each array module includes at least one horn antenna having a square aperture and a waveguide filter including a first piece and a second piece. The first piece and the second piece are separately molded, and the first piece includes a folded-back waveguide. The folded-back waveguide is a 90-degree fold-back waveguide and is coupled to the horn antenna. A first footprint of the waveguide filter is within a second footprint of an aperture of the horn antenna.

In yet other aspects, a method of providing an antenna array element for a phased array includes forming a horn antenna using a polymer material. The horn antenna has a square aperture. The method further includes forming a waveguide filter including a folded-back waveguide by separately molding a first piece and a second piece. The waveguide filter is coupled to the horn antenna via the folded-back waveguide. A first footprint of the waveguide filter is within a second footprint of an aperture of the horn antenna.

The foregoing has outlined rather broadly the features of the present disclosure in order that the detailed description that follows can be better understood. Additional features and advantages of the disclosure will be described hereinafter, which form the subject of the claims.

BRIEF DESCRIPTION OF THE DRAWINGS

For a more complete understanding of the present disclosure, and the advantages thereof, reference is now made to the following descriptions to be taken in conjunction with the accompanying drawings describing specific aspects of the disclosure, wherein:

FIGS. 5A through 5C are schematic diagrams illustrating various structural views of an example RX filter, according to certain aspects of the disclosure.

DETAILED DESCRIPTION

Figure 1A:
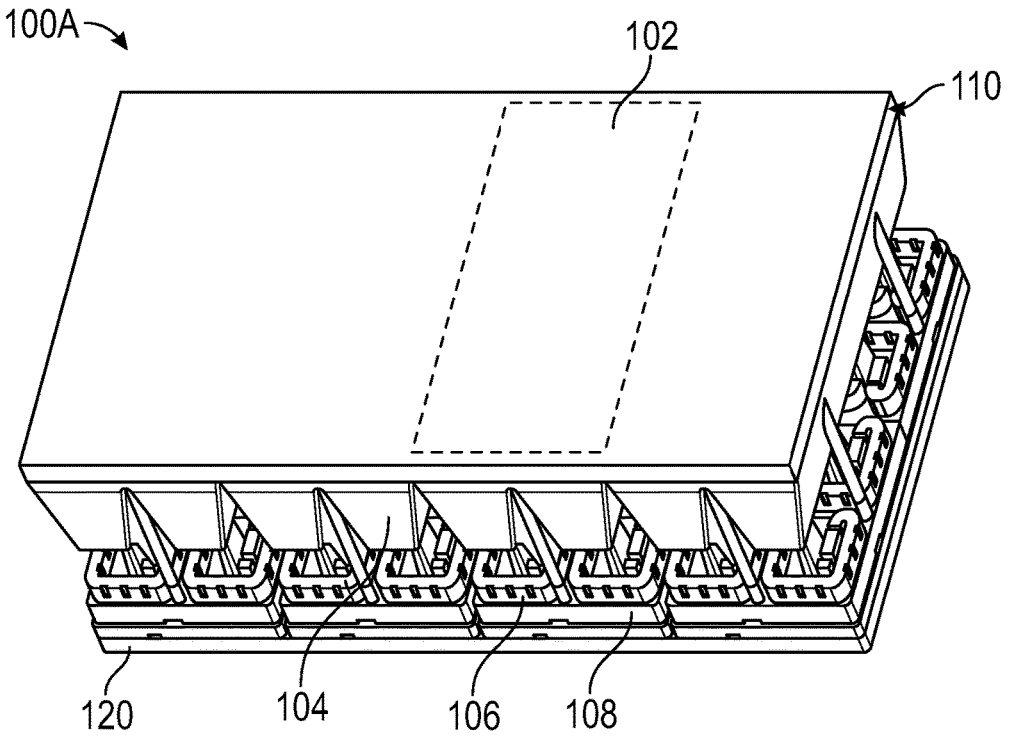
FIG. 1A is a high-level diagram illustrating an example structure of an antenna subarray, according to certain aspects of the disclosure.

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block diagram form in order to avoid obscuring the concepts of the subject technology.

According to some aspects of the subject technology, methods and configuration are described for providing active phased arrays for geostationary (GEO) and medium earth orbit (MEO) satellites. In particular, the subject technology relates to antenna aperture design aspects including the design of the antenna elements and one or more filters after the amplifiers such as solid-state power amplifier (SSPAs) for a transmit (TX) path, and one or more filters before the amplifiers such as low-noise amplifiers (LNAs) for a receive (RX) path. For GEO applications, the spacing between the antenna elements is typically in the order of 2.5-3 wavelengths. For MEO applications, the spacing between the antenna elements is typically in the order of 2 wavelengths. This may result in high antenna element loss if the antenna elements are implemented as a subarray of patches, dipoles, etc., due to losses associated with the stripline or microstrip combiner or splitter. If the antenna element is implemented as a single horn, the challenge is to achieve high aperture efficiency. The implementation may result in a long horn with high mass. The filter may suffer from substantial insertion loss (e.g., about 1.0-1.5 dB), when implemented in stripline or microstrip technology. When implemented in waveguide technology that intrinsically has low-loss, the challenge is to fit the filter inside the element envelope. Further, a waveguide filter could result in manufacturing and integration complexity, a high cost and a large mass.

In some implementations, a square horn antenna of the subject technology has dimensions of about 62 mm×62 mm and is attached to a waveguide filter configured for a Ku-band application. The subject technology further includes a square horn with dimensions of about 31 mm×31 mm that is attached to a waveguide diplexer designed for a Ka-band application. In both cases, the horns can be linearly polarized multi-mode horns optimized for the highest aperture efficiency over selected frequency bands. Aperture efficiency well over 90% over typically 20% frequency band and an aperture length comparable to the aperture diameter can be achieved in all cases.

In one or more implementations, to achieve circular polarization, a planar polarizer (e.g., a meander-line polarizer) can be placed over the horn aperture. The Ku-band bandpass filters for separate transmit (TX) and receive (RX) bands can be optimized for a set of filter requirements. By meandering the filter in one plane, the filter can be designed to fit inside the aperture envelope and to achieve desirable TX and RX filter performance (e.g., return loss and isolation). The predicted insertion loss can be substantially low, for example, in the order of about 0.15/0.20 dB over most of the TX and/or RX frequency bands. The same can be achieved for a Ka-band diplexer at about 20/30 GHz. The filters and diplexer may be placed on top of a multilayer board (MLB), for example, on its narrow wall, and can be folded and/or meandered via E-plane bends. For the input and output ports H-plane bends may be applied. Since the filters and diplexer mostly sit on the narrow or E-plane wall it can be split along the middle of the H-plane or broad wall where no currents are crossing. This greatly simplifies the integration of the filter and diplexer and is more forgiving if the bond line between the two split half waveguide filters is not desirably tight. The waveguide can be fed from the MLB via a probe or, capacitively, via a slot in the waveguide wall from a stripline or microstrip feed line. In summary, the design can be compliant with low-cost manufacturing and integration.

FIG. 1A is a high-level diagram illustrating an example structure of an antenna subarray 100A, according to certain aspects of the disclosure. The mechanical assembly for a space-based phased array may allow for a small array module to be used to produce large scale phased array systems. The phased array module may, for example, be based on a 31 and 62 mm antenna spacing, although the antenna spacing can be variable. The example antenna subarray (also referred to as a "tile") 100A includes a number of (e.g., 4, 8, 16 or more) array modules 102. Components of the array modules 102 (also referred to as "building blocks") of the antenna subarray 100A are sandwiched between a polarizer layer 110 and a mounting frame layer 120. For example, each array module 102 includes multiple (e.g., four) horn antenna elements 104 and filters 106 that are coupled via multilayer board (MLB) 108 to the mounting frame 120, as will be discussed in more detail herein.

In some implementations, the antenna subarray 100A can be a compact module built with dimensions of approximately 500 mm×500 mm×180 mm and can have a relatively low mass of about 15 Kg. In one or more implementations, the mounting frame layer 120 of the antenna subarray 100A can be installed on a spacecraft with spacecraft structure surrounding a phased array antenna formed of a number of antenna subarrays 100A.

Figure 1B:
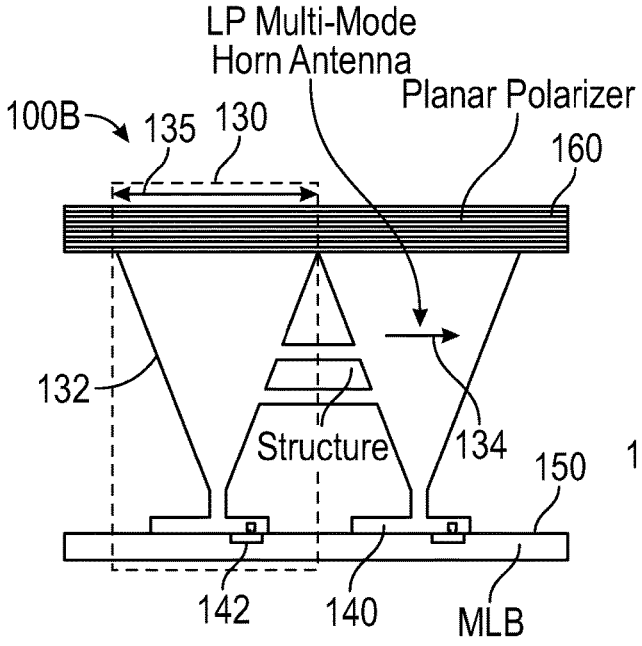
FIGS. 1B-1C are conceptual diagrams illustrating example structures of two adjacent antenna elements, according to certain aspects of the disclosure.
Figure 1C:
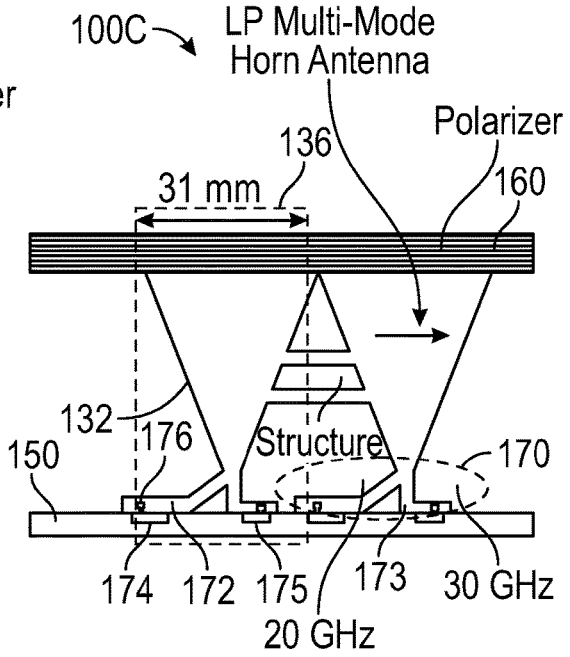

FIGS. 1B-1C are conceptual diagrams illustrating example structures of two adjacent antenna elements 100B and 100C, according to certain aspects of the disclosure. The two adjacent antenna elements 100B shown in FIG. 1B include similar antenna elements 130 and represent a large number of antenna elements. For example, for a Ku-band antenna array the number of antenna elements may be more than 500. The antenna element 130 is designed for Ku band (e.g., 10.70 GHz-12.75 GHz) and includes a horn 132, a waveguide filter 140, a polarizer 160 and a circuit layer connecting the amplifier to the waveguide filter via a probe 142. The waveguide filter 140 is coupled to the circuit layer 142, which is implemented in the multi-layer board (MLB) 150. The polarizer 160 can be a multi-layer polarizer. The circuit layer 142 includes a solid-state power amplifier (SSPA) to transmit, and a low-noise amplifier (LNA) to receive signals.

As seen from FIG. 1B, the dimensions of the waveguide filter 140 is such that it can fit within the aperture of the antenna element 130. In one or more implementations, the horn 132 is a linearly polarized (LP) multi-mode square horn antenna (e.g., with a square aperture). The dimensions of the aperture of the antenna element 130, as depicted by the arrow 135, is between 2.5λ to 3.0λ, for GEO, and about 2.0λ for MEO, where λ is the wavelength associated with the center frequency of the Ku band. An arrow 134 on the horn antenna shows the direction of the electric field in the horn antenna.

The two adjacent antenna elements 100C shown in FIG. 1C include similar Ka-band antenna elements 136 and represent a large number of antenna elements. For example, for the Ka-band (e.g., 20 GHz-30 GHz) the number of antenna elements can exceed about 2000. The antenna elements 136 includes the horn 132, a waveguide diplexer 170, the polarizer 160, circuit layers 174 and 175 and a feed probe 176. In some implementations, the waveguide diplexer 170 includes a low-pass filter 172, and a bandpass filter 173. The low-pass filter 172 can pass frequencies in the TX band (e.g., 17.6 GHz to 22.0 GHz) and the bandpass filter 173 can pass frequencies in the RX band (e.g., 27.5 GHz to 31.0 GHz). The low-pass filter 172 and the bandpass filter 173 are coupled to the circuit layer 174 and 175, respectively, which are implemented in the multi-layer board (MLB) 150. The circuit layer 174 (in the TX path) can include a power amplifier, such as a SSPA, and the circuit layer 175 (in the RX path) can include an LNA.

Figure 2B:
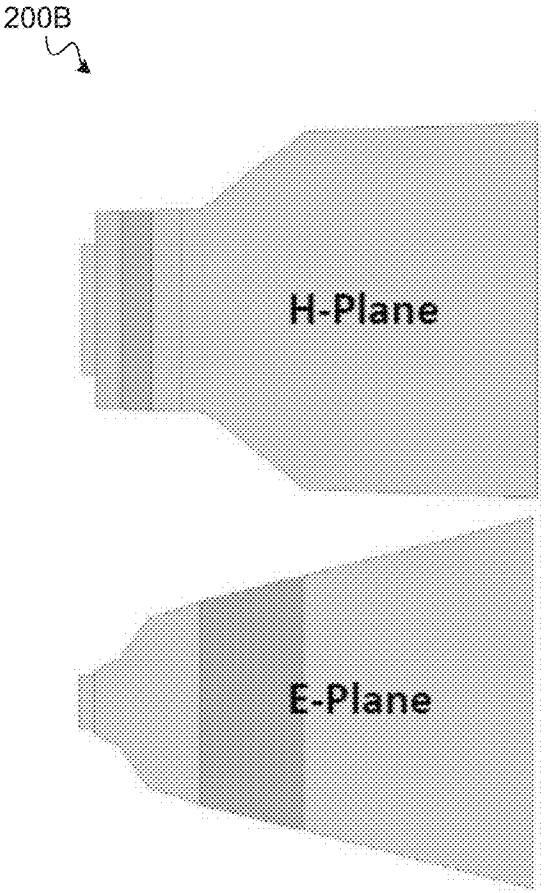
FIGS. 2A-2B are schematic diagrams illustrating an example structure of a horn antenna of the antenna subarray of FIG. 1A and corresponding H-plane and E-plane cross-sectional views, according to certain aspects of the disclosure.
Figure 2A:
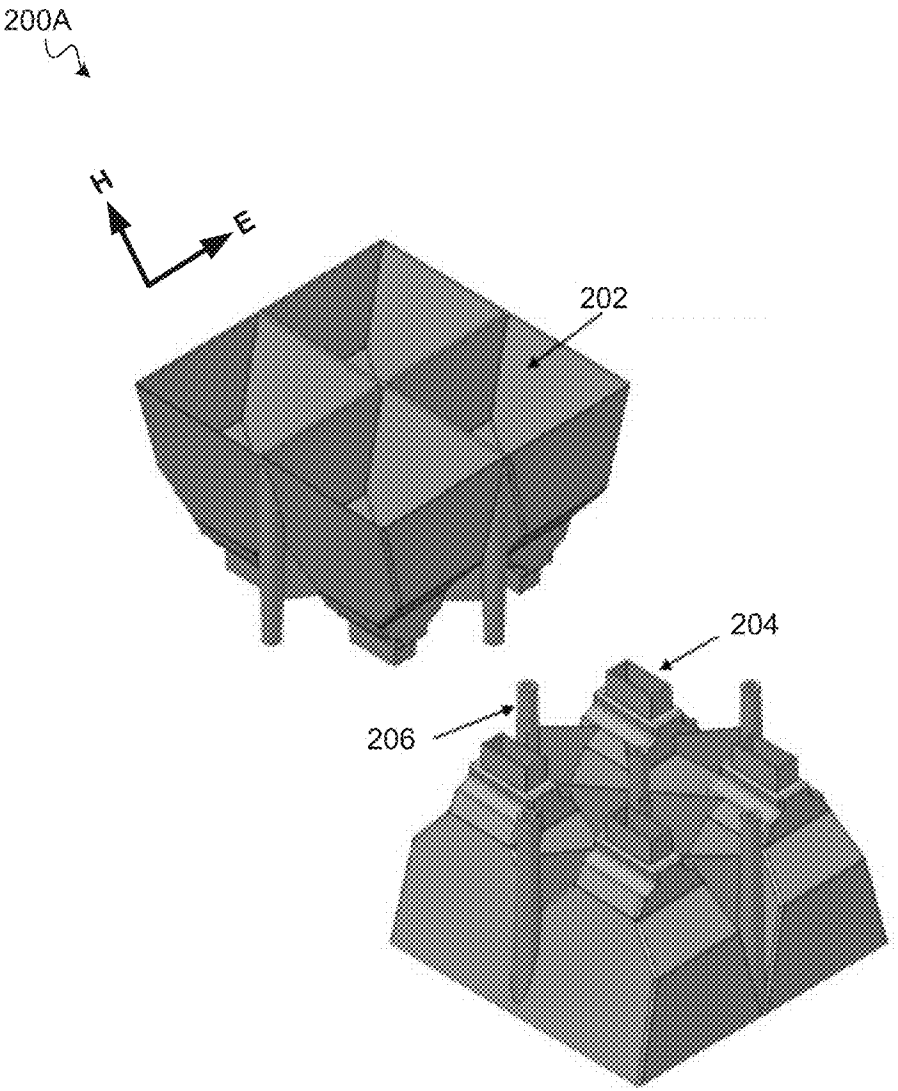

FIGS. 2A-2B are schematic diagrams illustrating an example structure of a horn antenna of the antenna subarray 200A of the array module 102 of FIG. 1A and corresponding H-plane and E-plane cross-sectional views, according to certain aspects of the disclosure. In some implementations, the example horn antenna 200A includes four feeds on an approximately 62 mm pitch, but is not limited to four feeds and can include a higher number of feeds. In one or more implementations, the aperture 202 of the horn antenna 200A is a square with a side dimension within a range of about 50-70 mm, and the wall thickness of the horn antenna 200A is about 0.5 mm. In one or more implementations, the horn antenna 200A is made by using injection molding of a glass filled resin (e.g., Ultem) or a metal coated polymer. An interface 204 couples the horn antenna 200A to a waveguide filter (not shown for simplicity). Mounting bosses 206 with threaded inserts are used to mount the waveguide filter to the horn antenna 200A. The horn antenna 200A and the waveguide filter (discussed below) form an aperture layer that also serves as a protective and shielding enclosure for the electronic assemblies coupled to the aperture layer. Elements of the aperture layer can be designed around low cost, high volume manufacturing processes without the high cost typically associated with satellite components or the high mass associated with machined metal components. The aperture layer is combined with a circuit layer discussed below. The disclosed approach allows for varying aperture spacing and improved manufacturability.

FIG. 2B shows cross-sectional views of each horn antenna element across an H-plane and an E-plane. The H-plane is a plane parallel to the magnetic field vector H and perpendicular to the aperture 202, and the E-plane is a plane parallel to the electric field vector E and perpendicular to the aperture 202.

Figure 3:
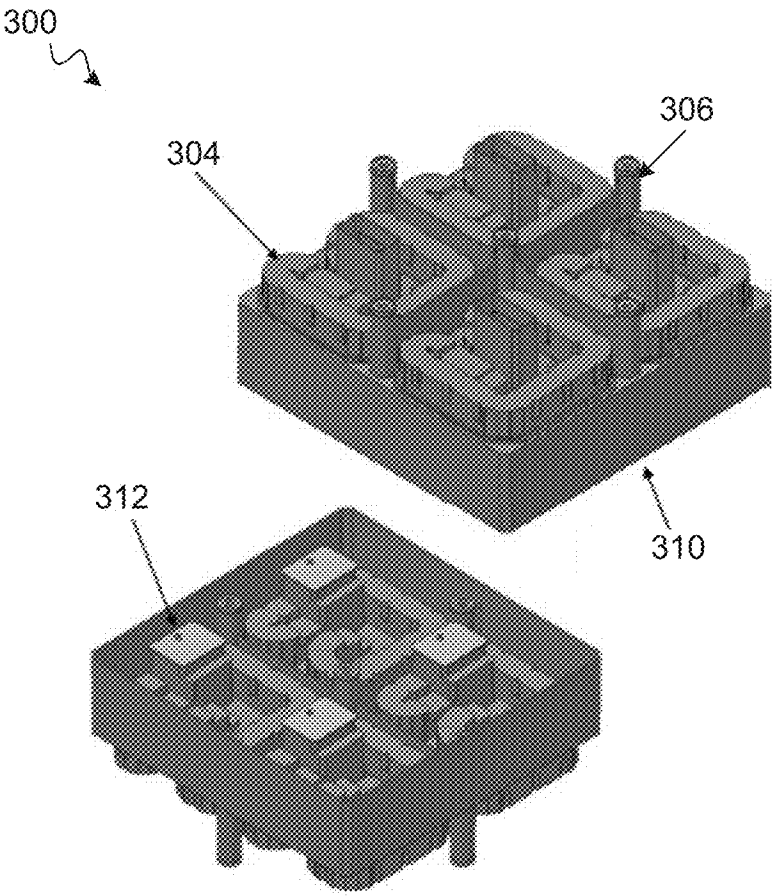
FIG. 3 is a schematic diagram illustrating various views of the example structure of a waveguide filter of the antenna subarray of FIG. 1, according to certain aspects of the disclosure.

FIG. 3 is a schematic diagram illustrating various views of the example structure of a waveguide filter 300 of the antenna subarray of FIG. 1, according to certain aspects of the disclosure. The waveguide filter 300 includes an upper half 304 and a lower half 310 that can be separately molded. The waveguide filter 300 has a folded-back waveguide structure that at one end is coupled to the interface 204 of FIG. 2A and at the other end is coupled via a probe launch cover 312 to a circuit layer. Also shown in the waveguide filter 300, there are mounting buses 306 that can be coupled to mounting buses 206 of FIG. 2A.

Figure 4:
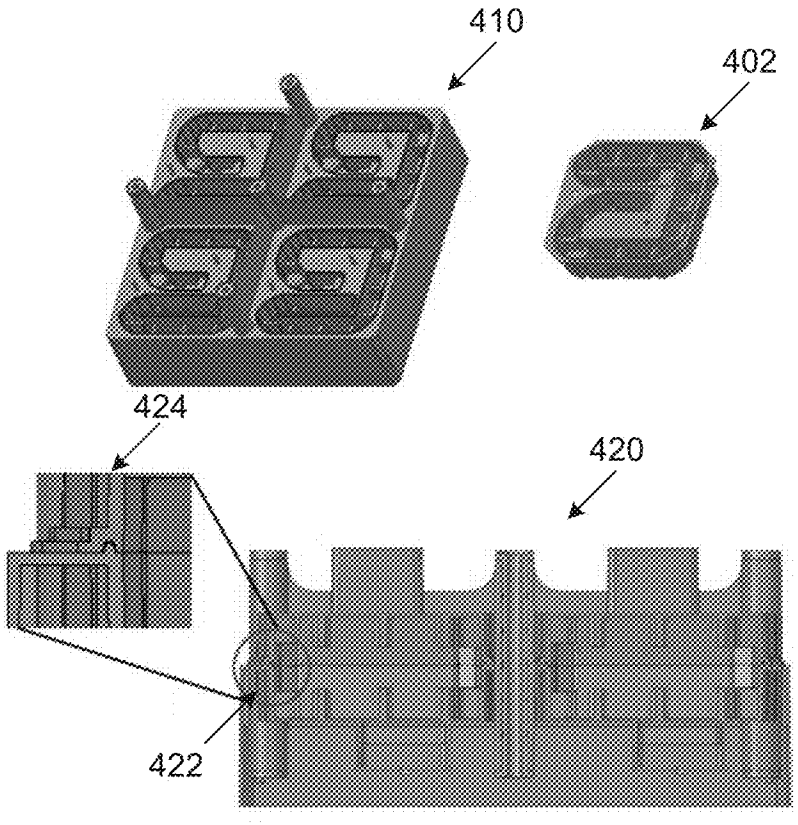
FIG. 4 is a schematic diagram illustrating various views of the example structure of the waveguide filter of FIG. 3, according to certain aspects of the disclosure.

FIG. 4 is a schematic diagram illustrating various views of the example structure of the waveguide filter of FIG. 3, according to certain aspects of the disclosure. The perspective view 410 of FIG. 4 depicts the structure of the lower half 310 of the waveguide filter 300, which match the structure of the upper half 304 of FIG. 3. The upper half 304 of the waveguide filter 300 can be molded separately from the lower half 310 of FIG. 3 and is shown in the bottom view 402 to disclose that the upper half 304 is hollow with a configuration that matches that of the lower half 310 of the waveguide filter 300, as shown in the top view 410 of the lower half 310. The upper and lower halves 304 and 310 can be bonded together using, for example, a silver-filed epoxy. Alignment features such as shown in an exploded view 424 of a section 422 of the cross-sectional view 420 allow for aligning the parts before and after bonding.

FIGS. 5A through 5C are schematic diagrams illustrating various structural views 500A through 500C showing an example RX waveguide filter 540, according to certain aspects of the disclosure. The perspective view 500A of FIG. 5A shows the RX waveguide filter 540 (hereinafter "filter 540") coupled through an input waveguide 560 to feed probe 572 that couples the filter 540 to an MLB feed stripline 570. The filter 540 is fabricated by injection molding of two separate pieces that are joined along a filter split line 542. The filter split line 542 runs through the middle of an H-plane wall (substantially parallel to the H field on the wall) of the filter where no electric current crosses. The first piece 544 of the filter 540 includes a folded-back waveguide 550 having a waveguide port 552, which allows coupling the filter 540 to a horn antenna.

The cross-sectional view 500B of FIG. 5B shows cross-sectional views of the folded-back waveguide 550, the waveguide port 552, the MLB feed line 570 and the feed waveguide 572. The top view 500C of FIG. 5C reveals the rectangular shape of the filter 540 and depicts the MLB feed line 570 and the feed waveguide (probe) 572.

Figure 6B:
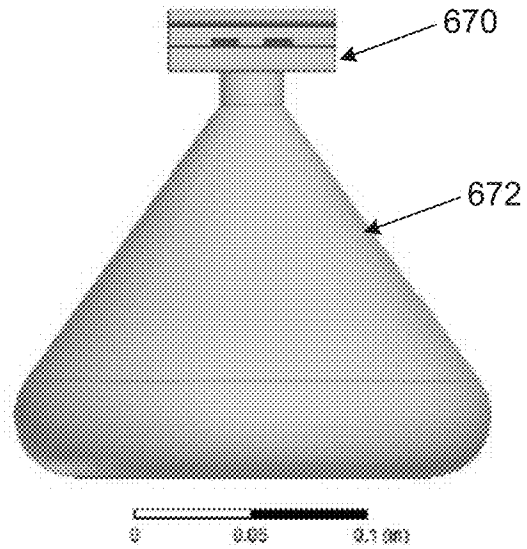
FIGS. 6A-6B are schematic diagrams illustrating an example of a multi-layer board (MLB) stripline feed and a corresponding input waveguide, according to certain aspects of the disclosure.
Figure 6A:
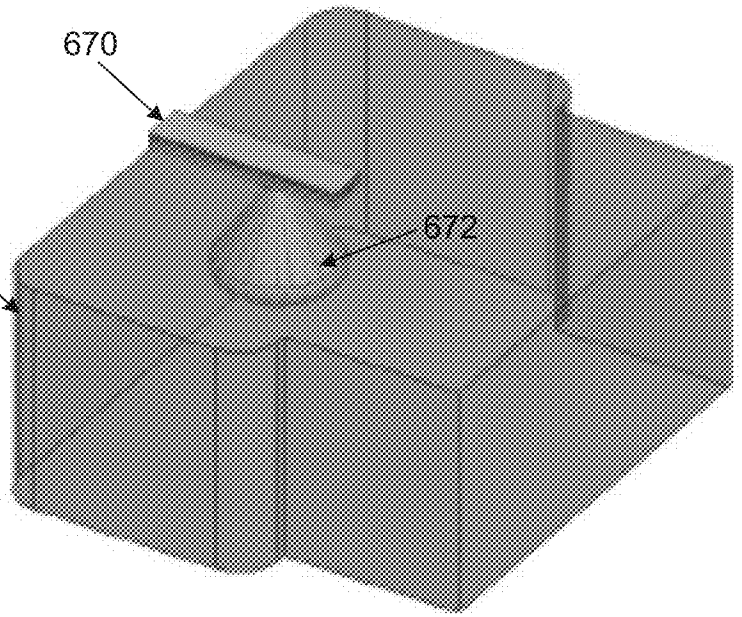

FIGS. 6A-6B are schematic diagrams illustrating an example of an MLB stripline feed 670 and a corresponding input waveguide 660, according to certain aspects of the disclosure. The input waveguide 660 is similar to the input waveguide 560 of FIG. 5A. The MLB feed stripline 670 and the feed waveguide (probe) 672 shown in FIGS. 6A and 6B are similar to the MLB feed stripline 570 and the feed waveguide 572 of FIG. 5A, and are shown herein to reveal more details. The MLB feed stripline 670 is coupled to the MLB 150 of FIGS. 1B and 1C.

Figure 7B:
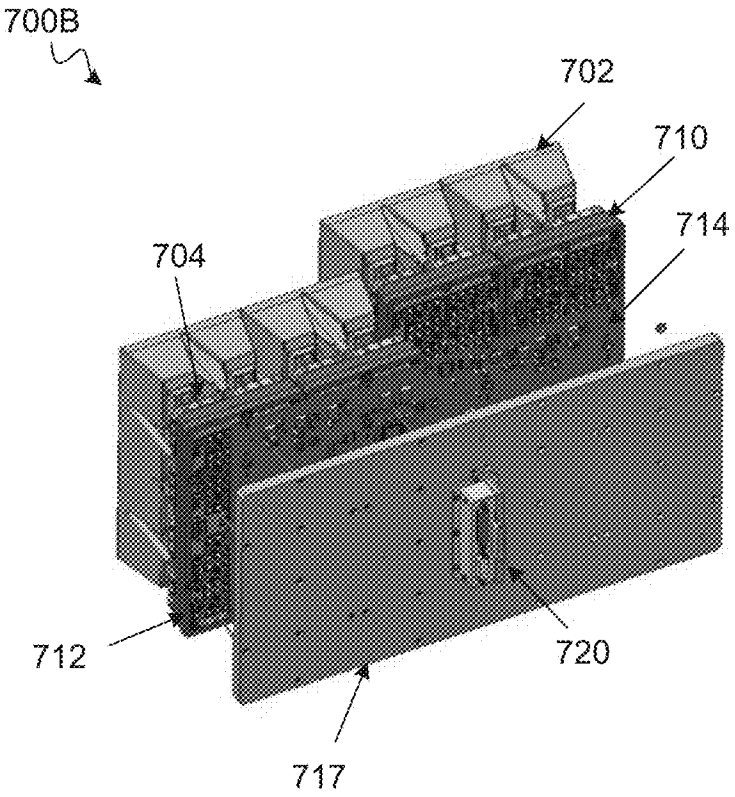
FIGS. 7A-7B are schematic diagrams illustrating exploded views of various components of the example antenna subarray of FIG. 1A, according to certain aspects of the disclosure.
Figure 7A:
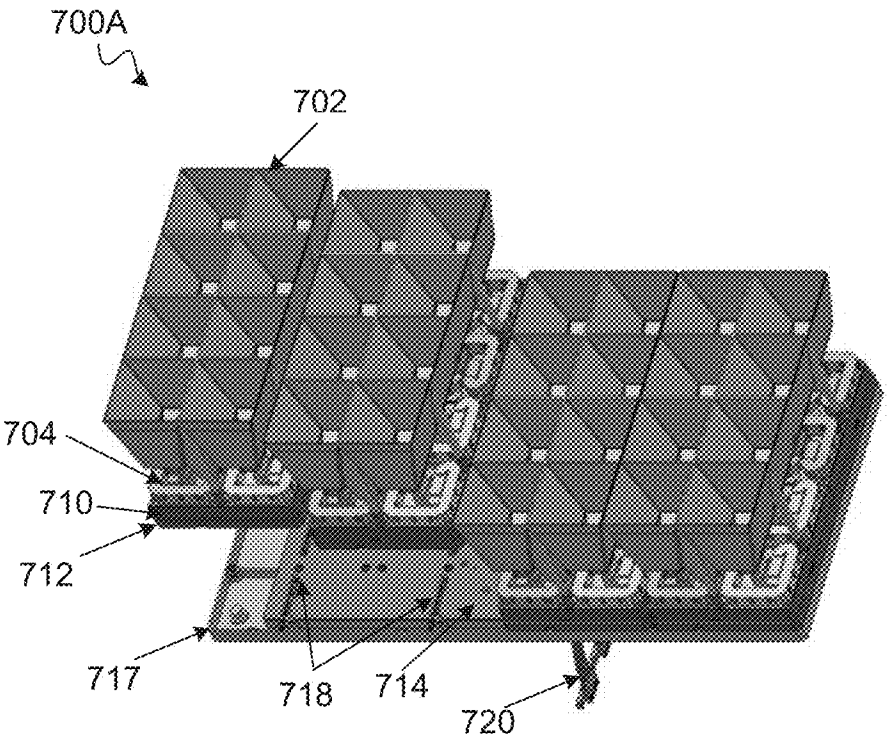

FIGS. 7A-7B are schematic diagrams illustrating exploded views of various components of the example antenna subarray of FIG. 1A, according to certain aspects of the disclosure. FIGS. 7A-7B are schematic diagrams illustrating exploded views 700A and 700B of various components of the example subarray 100A of FIG. 1A, according to certain aspects of the disclosure. The exploded view 700A shows the square horn antenna 702, waveguide filters including an upper half 704 and a lower half 710, a circuit layer including an MLB 712, a distribution layer 714 including interposers 718 (e.g., RF and DC interposers), a mounting frame 717 and an input/output (I/O) connector 720. The square horn antenna 702 is a 4×4 structure including 16 horn antenna elements (e.g., each associated with an array module), but is not limited to 16 and can be made of less or more number of horn antenna elements. The upper half waveguide filters are folded-back waveguides as described above which are placed in the lower half 710 that couples the square horn antenna 702 to the mounting frame 717 of the circuit layer. The distribution layer 714 couples the I/O connector 720 to the mounting frame 717. The interposers 718 electrically couple circuit layers of different array modules. Further, connections between the array modules and the backplane are achieved using the same interposers connecting the circuit layer. Each array module of the subject technology is thermally and spatially isolated with a clearance gap to adjacent array modules to minimize thermal distortion effects between array modules. This prevents degrading of a satellite's performance due to thermal distortion between array modules in the antenna array.

The exploded view 700B shows another view of the structure shown in FIG. 7A and includes the square horn antenna 702, the waveguide filters including the upper half 704 and a lower half 710, the circuit layer including the MLB 712, the distribution layer 714, the mounting frame 717 and the I/O connector 720. The RF, optical, power, control and other signals are provided to the distribution layer via I/O connectors 720 and satellite harness connections. The tiles (e.g., antenna subarrays 100A of FIG. 1A) are combined to form a scalable phased-array system. Individual tiles can be added or removed without impacting adjacent tiles. This reduces satellite assembly cost, time and effort. The mechanical assembly for a space-based phased array allows for a small array module to be used to produce large scale phased-array systems.

Figure 8A:
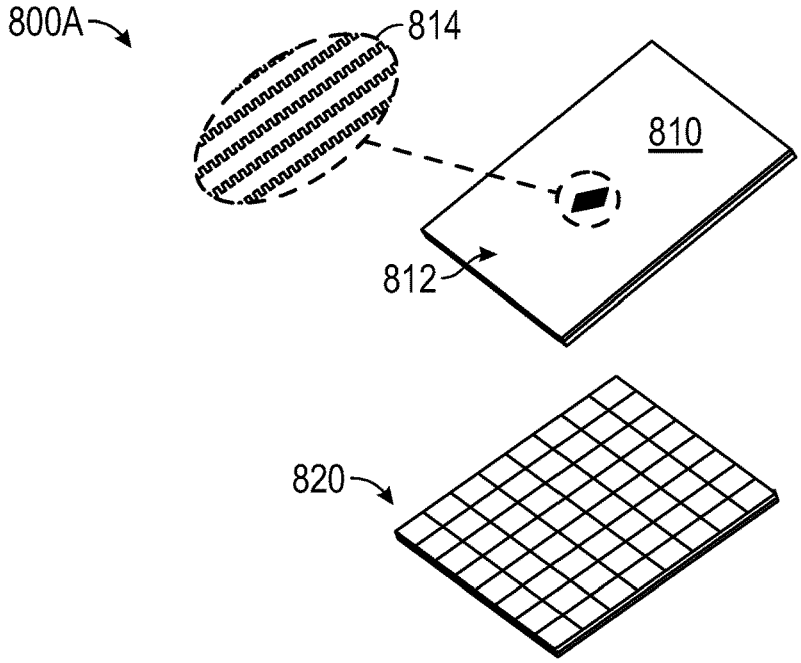
FIGS. 8A through 8C are schematic diagrams illustrating examples of meanderline and waveguide polarizers, according to certain aspects of the disclosure.
Figure 8B:
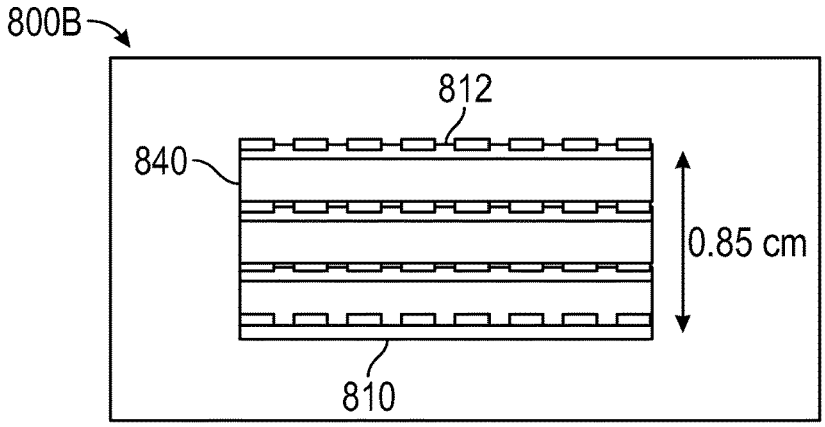
Figure 8C:
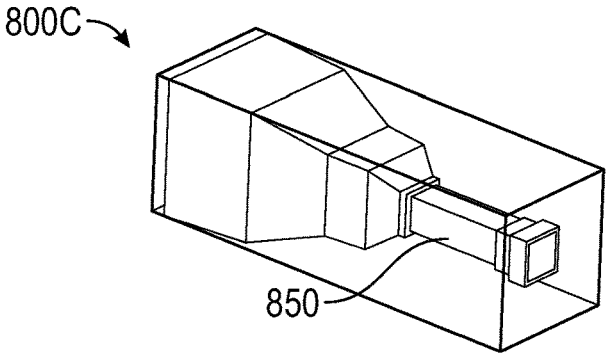

FIGS. 8A through 8C are schematic diagrams illustrating examples of meanderline and waveguide polarizers, according to certain aspects of the disclosure. FIG. 8A is a schematic diagram illustrating an example structure of a meanderline polarizer 800A of the antenna subarray 100A of FIG. 1A. The meanderline polarizer 800A is used to convert between linear polarization of the antenna subarray 100A to a circular polarization. The meanderline polarizer 800A can be a multi-layer structure with an approximate thickness of about 0.5-1 wavelength including an outer face layer 810 and an inner face layer 820. In one or more implementations, the outer face layer 810 includes a surface layer meander 812, the structural detail of which is shown in the exploded view 814, where the incoming linear polarization vector is substantially at a 45 degree angle with the length of the meander structure. The surface layer meander 812 is, in addition to converting the field between linear and circular polarization, also used to bleed charge from a front face of the antenna. The meanderline polarizer 800A may be covered by a sun blocking radome.

Depicted in FIG. 8B is a cross-sectional view 800B of the meanderline polarizer 800A of FIG. 8A. The cross-sectional view 800B shows an example of a four-layer structure of a meanderline polarizer. Each layer includes the outer face layer (e.g., a Mylar film) 810 and the surface layer meander (e.g., meanderline strips) 812. The polarizer layers are separated by layers of low dielectric constant material, e.g. foam spacer 840. The foam spacer (e.g., HF31 foam) can be a quarter-wavelength spacer. In some implementations, the multilayer structure may include more or less numbers of layers than the four layers shown in FIG. 8B. The meanderline polarizer enables linearly polarized (LP) horns with higher horn aperture efficiency and gain and lower height. The aperture efficiency can ideally be 100% corresponding to a uniform amplitude and phase distribution over the aperture (e.g. horn radiating aperture). Typical horn antennas may have less than 100% aperture efficiency.

In some embodiments, the polarizer can be a waveguide polarizer, an example of which is a septum polarizer 850 shown coupled to a horn antenna element 800C of FIG. 8C. The waveguide polarizer 850 can be installed between the filter(s) and the feed structure.

Figure 9A:
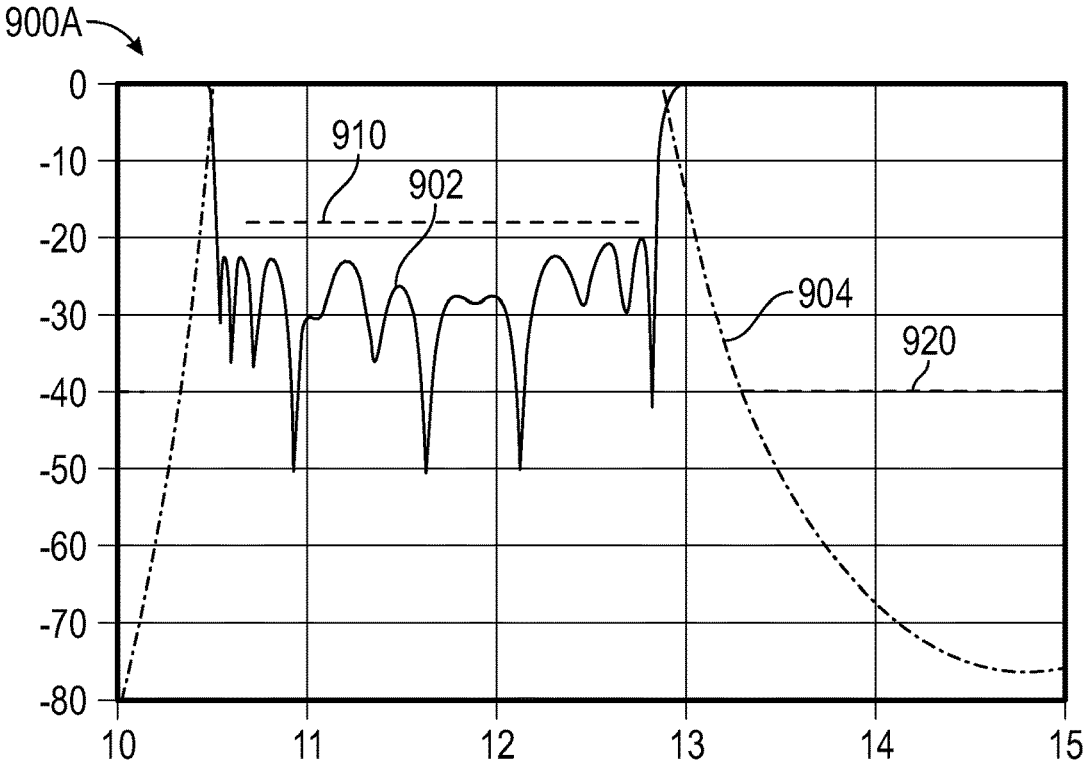
FIGS. 9A-9B are charts illustrating simulation results of an exemplary transmit (TX) filter, according to certain aspects of the disclosure.
Figure 9B:
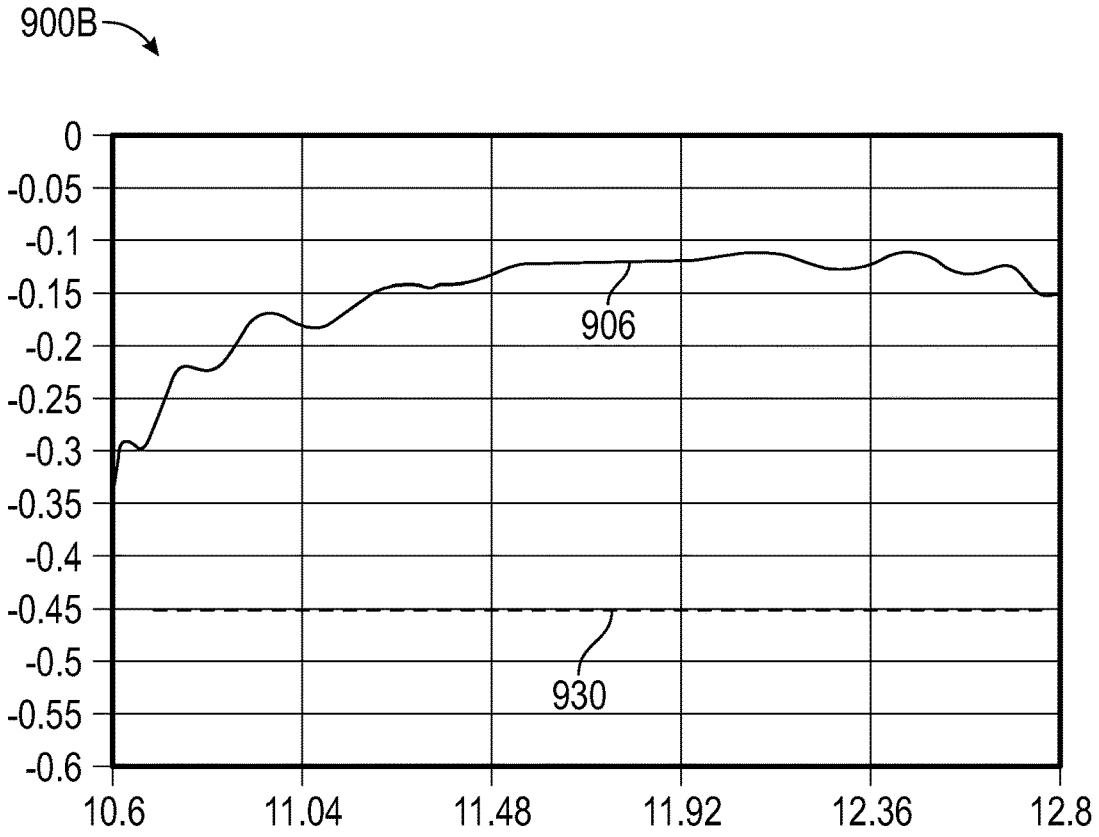

FIGS. 9A-9B are charts 900A and 900B illustrating example simulation results of an exemplary transmit (TX) filter, according to certain aspects of the disclosure. The chart 900A of FIG. 9A shows plots 902 and 904 and corresponding specification limits 910 and 920. Plots 902 and 904 depict a return loss as a function of frequency and a frequency response of the TX filter, respectively. The return loss is less than −25 dB for an about 2 GHz bandwidth of the Ku band. The corresponding specification limits 910 and 920 are defined by the system design. The simulated results shown by plots 902 and 904 are seen to be well within the corresponding specification limits 910 and 920.

The chart 900B of FIG. 9B shows a plot 906 and a corresponding specification limit 930. The plot 906 depicts an insertion loss as a function of frequency for the TX filter. The insertion loss is better than −0.25 dB for a large portion of the Ku-TX band (e.g., between 10.9 GHz to 12.8 GHz). The simulated result shown by plot 906 is seen to be well above the corresponding specification limit 930. The simulations are made with the assumption that the filters are copper plated and have a roughness of 64 μm.

Figure 10A:
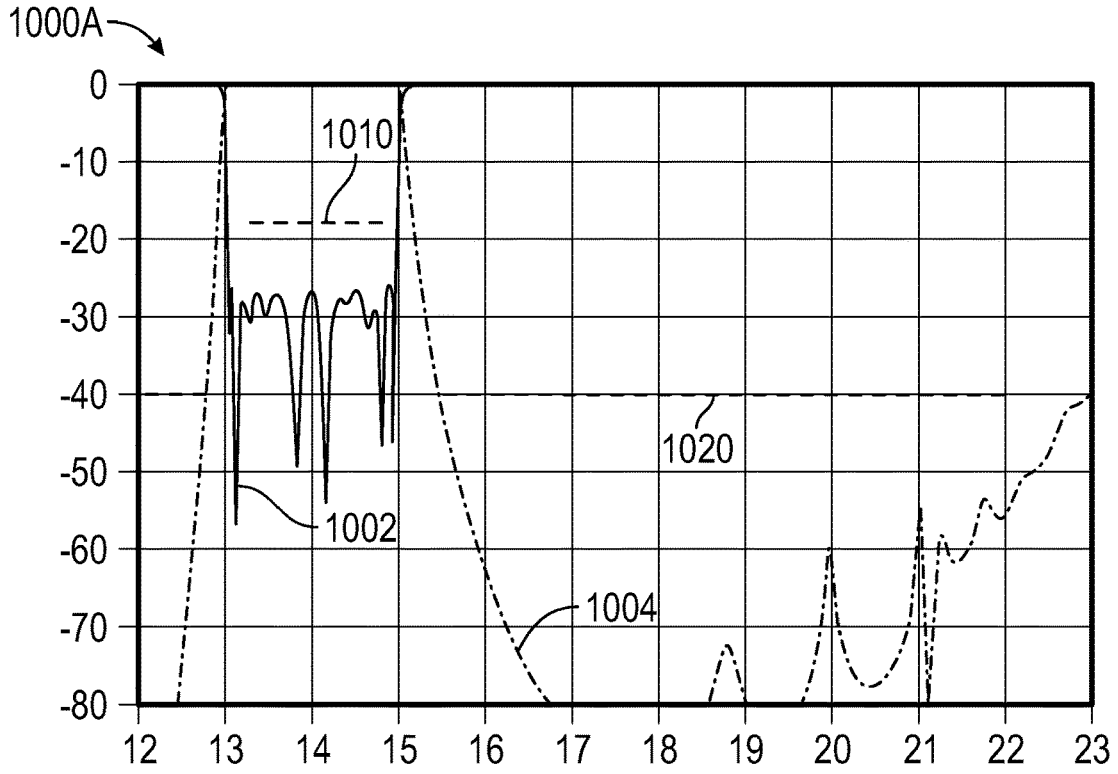
FIGS. 10A-10B are charts illustrating simulation results of an exemplary receive (RX) filter, according to certain aspects of the disclosure.
Figure 10B:
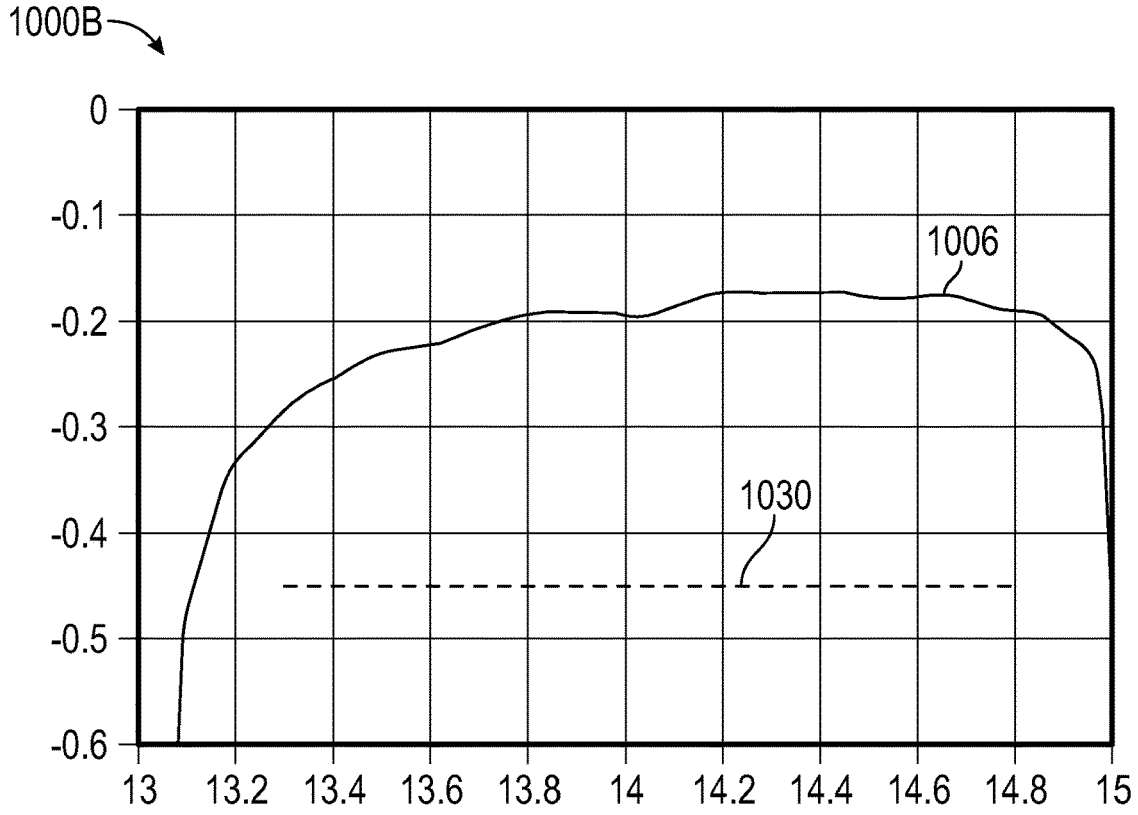

FIGS. 10A-10B are charts 1000A and 1000B illustrating simulation results of an exemplary receive (RX) filter, according to certain aspects of the disclosure. The chart 1000A of FIG. 10A shows plots 1002 and 1004 and corresponding specification limits 1010 and 1020. Plots 1002 and 1004 depict a return loss as a function of frequency and a frequency response of the RX filter, respectively. The return loss is less than −28 dB for an about 2 GHz bandwidth of the Ku band. The simulated results shown by plots 1002 and 1004 are seen to be well within the corresponding specification limits 1010 and 1020.

The chart 1000B of FIG. 10B shows a plot 1006 and a corresponding specification limit 1030. The plot 1006 depicts an insertion loss as a function of frequency for the TX filter. The insertion loss is better than −0.3 for a large portion of the Ku-RX band (e.g., between 13.3 GHz to 14.8 GHz). The simulated result shown by plots 1006 is seen to be well above the corresponding specification limit 1030. The simulations are made with the assumption that the filters are copper plated and have a roughness of 64 μm.

Figure 11:
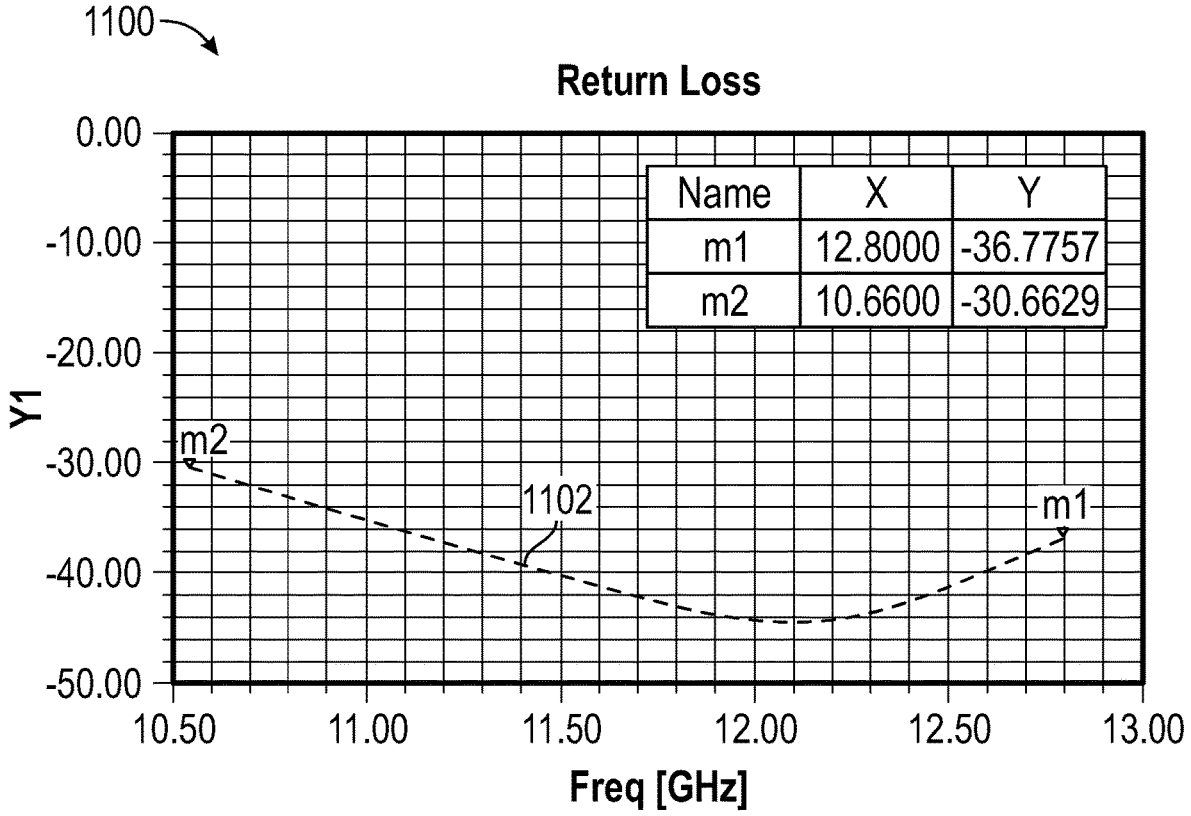
FIG. 11 is a chart illustrating a simulation result of an exemplary MLB stripline, according to certain aspects of the disclosure.

FIG. 11 is a chart 1100 illustrating a simulation result of an exemplary MLB stripline, according to certain aspects of the disclosure. The chart 1100 shows a plot 1102 depicting a return loss as a function of frequency for a TX feed waveguide (e.g., 672 of FIGS. 6A and 6B). The return loss, as shown in FIG. 11, is less than −30 dB for the majority of the frequencies of the TX Ku band (e.g., between 10.55 GHZ to 12.8 GHz).

Figure 12A:
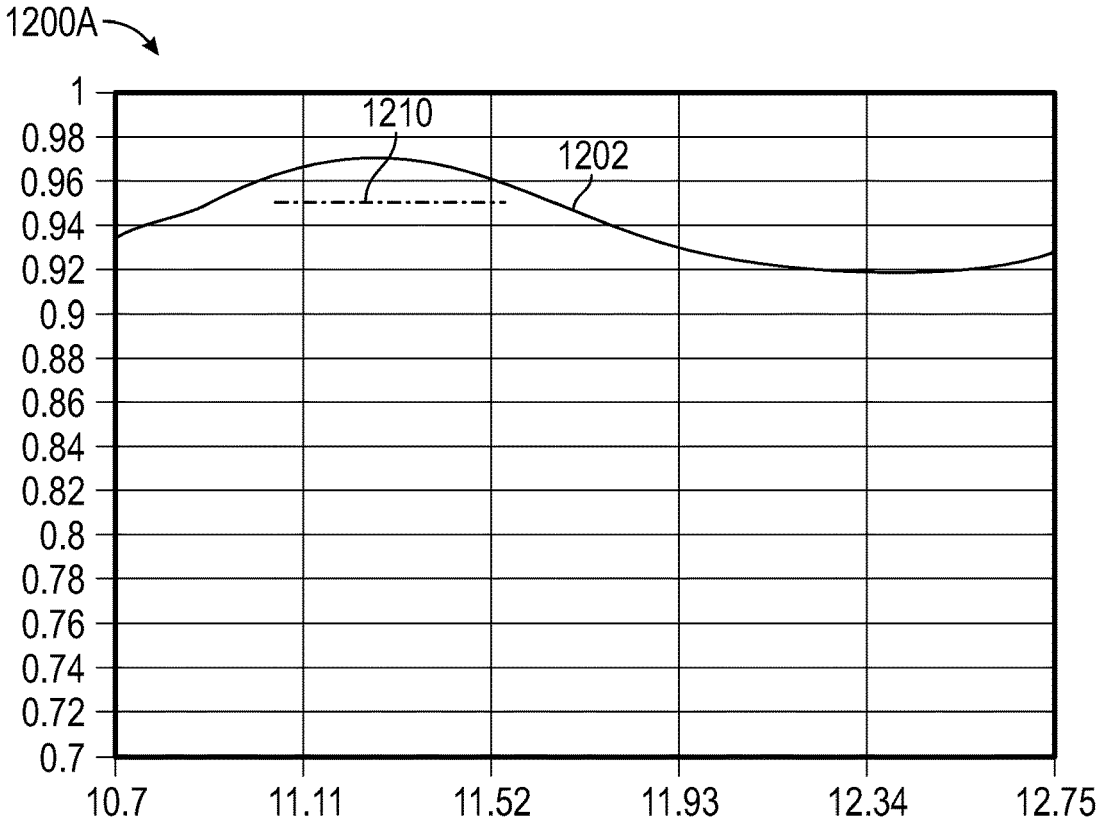
FIGS. 12A-12B are charts illustrating simulation results of an exemplary TX antenna element, according to certain aspects of the disclosure.
Figure 12B:
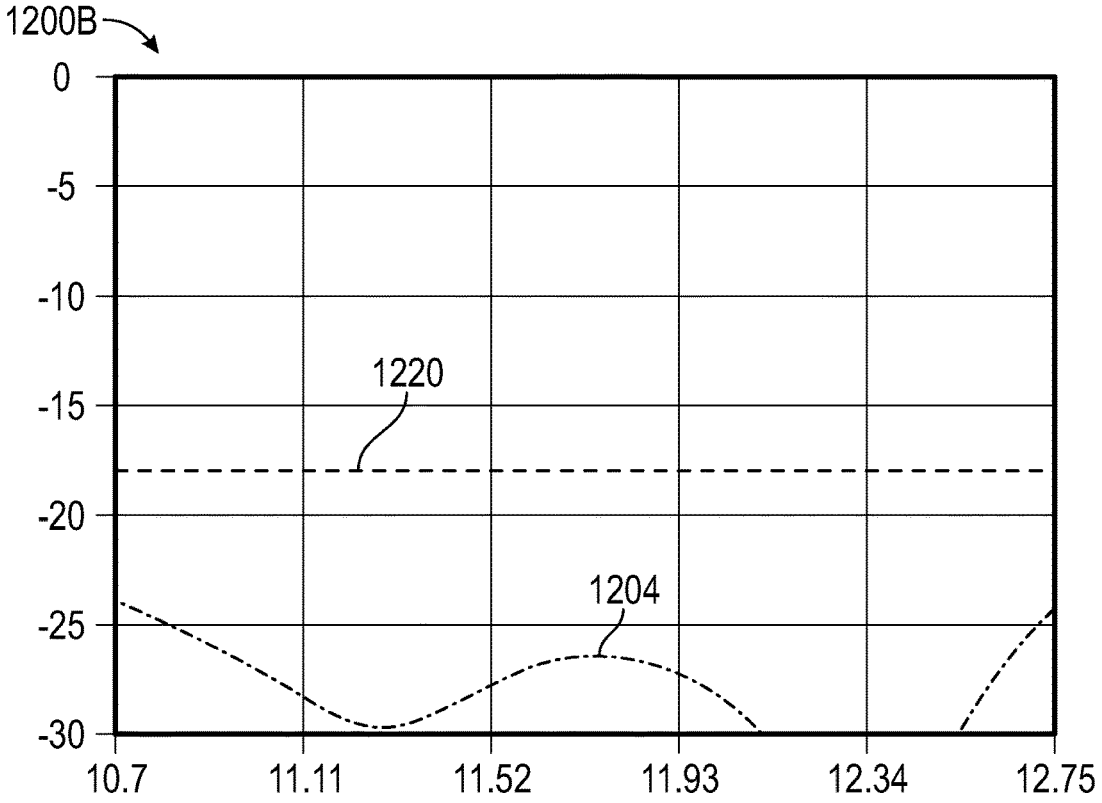

FIGS. 12A-12B are charts 1200A and 1200B illustrating simulation results of an exemplary TX antenna element, according to certain aspects of the disclosure. The chart 1200A depicts a plot 1202 of aperture efficiency as a function of frequency for a TX antenna element. The simulation result depicted by the plot 1202 shows the TX antenna element has aperture efficiency better than about 96% within an about 500 MHz band shown by a band indicator 1210.

The chart 1200B of FIG. 12B depicts a plot 1204 of return loss as a function of frequency for a TX antenna element. The simulation result depicted by the plot 1204 shows the TX antenna element has return loss less than about −25 dB for a range of frequencies between about 10.9 GHz and 12.7 GHz, which is well below a level shown by a specification limit 1220.

Figure 13A:
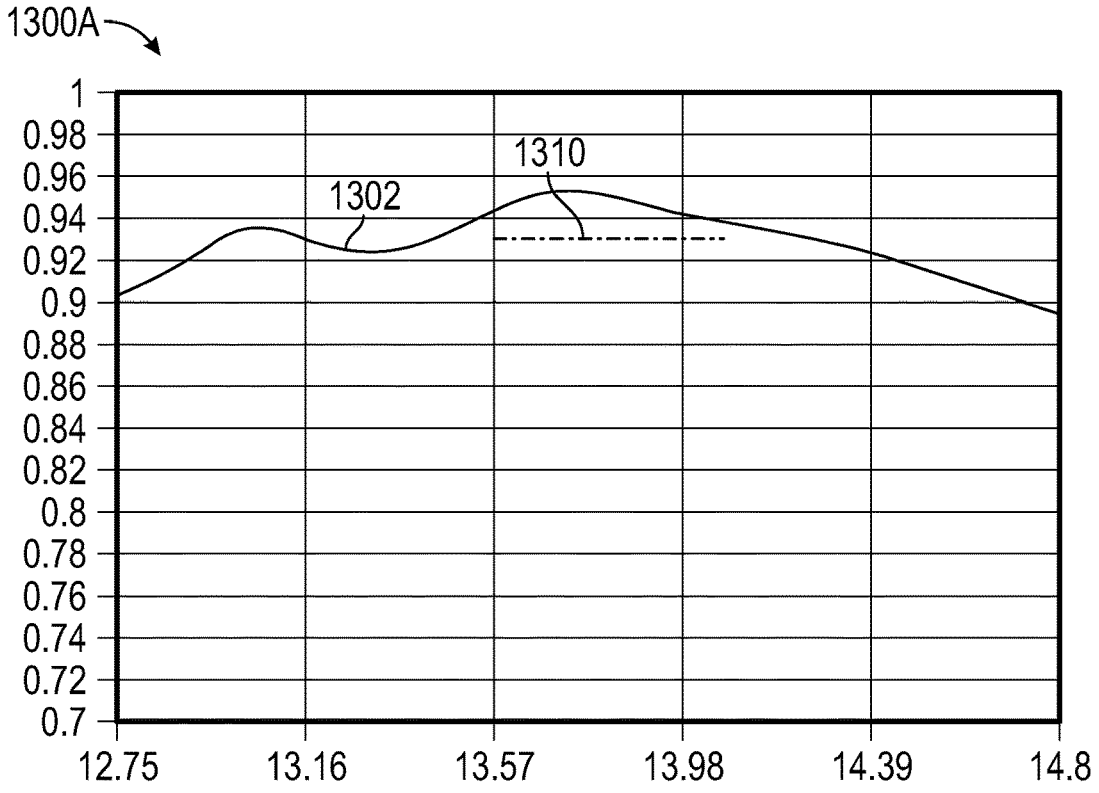
FIGS. 13A-13B are charts illustrating simulation results of an exemplary RX antenna element, according to certain aspects of the disclosure.
Figure 13B:
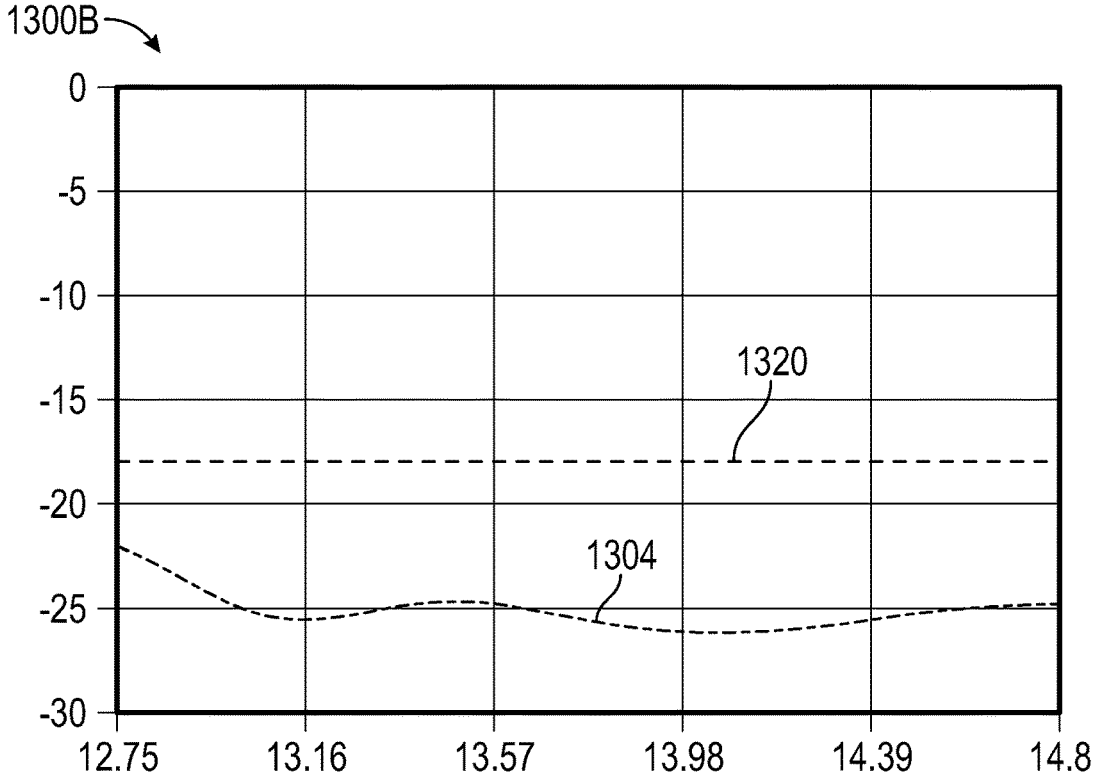

FIGS. 13A-13B are charts 1300A and 1300B illustrating simulation results of an exemplary RX antenna element, according to certain aspects of the disclosure. The chart 1300A depicts a plot 1302 of aperture efficiency as a function of frequency for an RX antenna element. The simulation result depicted by the plot 1302 shows the RX antenna element has aperture efficiency better than about 94% within an about 500 MHz band shown by a band indicator 1310.

The chart 1300B of FIG. 13B depicts a plot 1304 of return loss as a function of frequency for a RX antenna element. The simulation result depicted by the plot 1304 shows the RX antenna element has return loss less than about −25 dB for a range of frequencies between about 13. GHz and 14.6 GHz, which is well below a level shown by a specification limit 1320.

Figure 14:
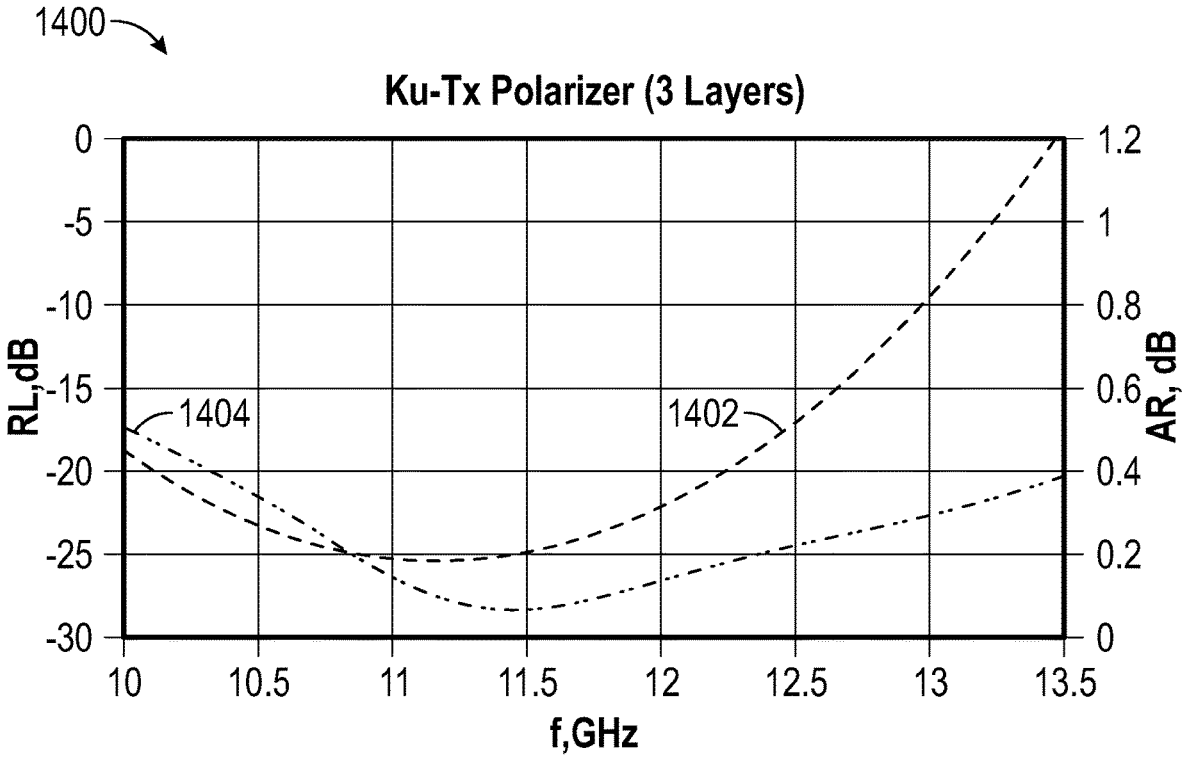
FIG. 14 is a chart illustrating simulation results of an exemplary Ku-TX polarizer, according to certain aspects of the disclosure.

FIG. 14 is a chart 1400 illustrating simulation results of an exemplary Ku-TX polarizer, according to certain aspects of the disclosure. The chart 1400 shows plots 1402 and 1404 depicting axial ratio (AR) and return loss as a function of frequency for a meanderline Ku-TX polarizer (e.g., 800C of FIG. 8C). The axial ratio is a ratio of the length of the major and minor axes of a corresponding polarization ellipse of the polarizer. The return loss is less than −23 dB for a range of frequencies between about 10.7 GHz and 12.75 GHz, and the axial ratio is within a range of about −15 dB to −25 dB for a range of frequencies between about 10.7 GHz and 12.75 GHz.

Figure 15A:
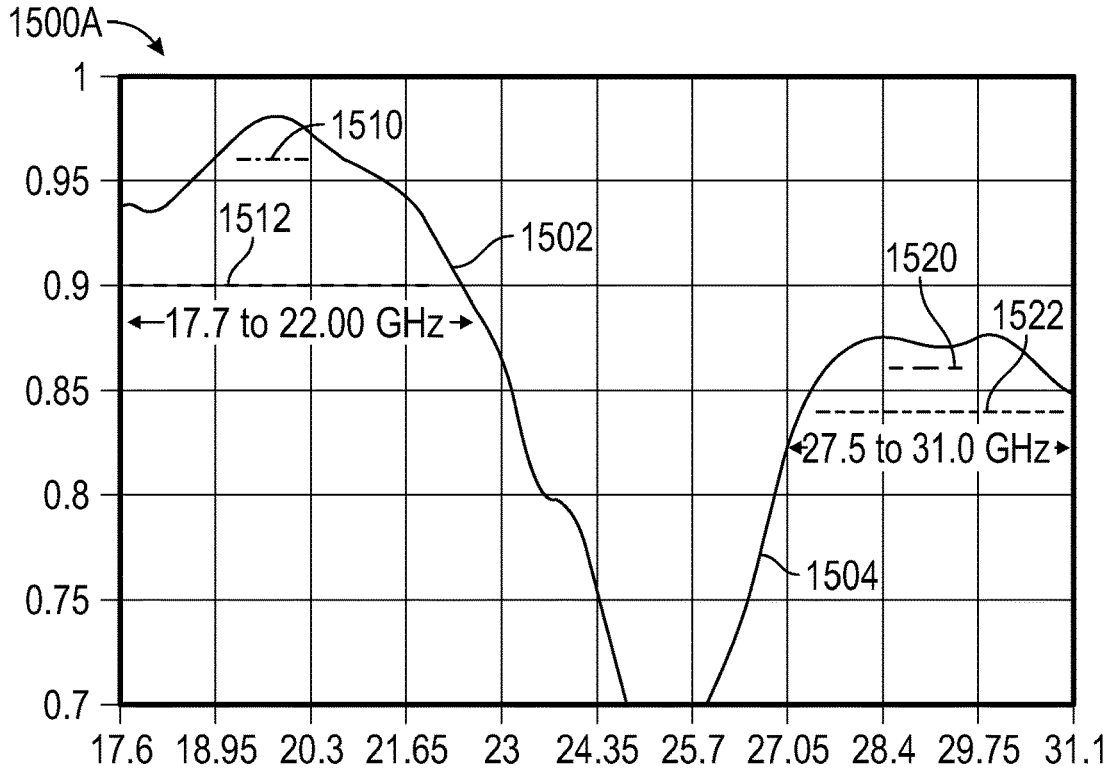
FIGS. 15A-15B are charts illustrating simulation results of an exemplary horn antenna element, according to certain aspects of the disclosure.
Figure 15B:
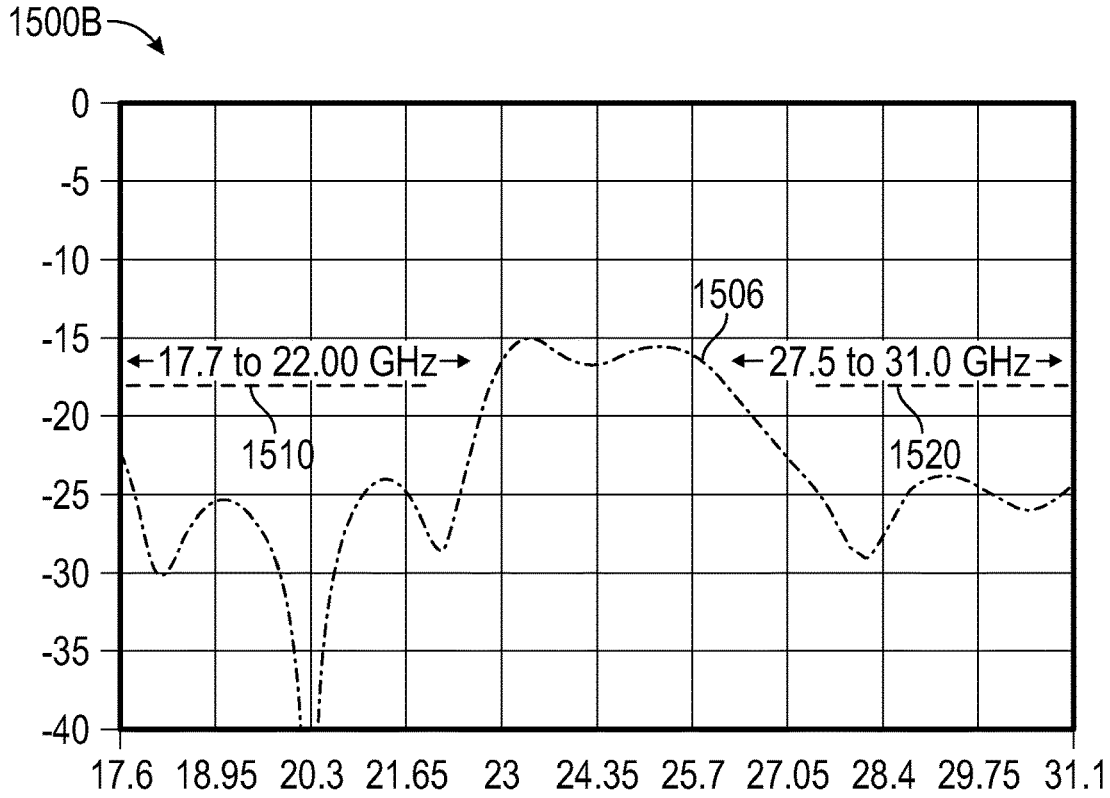

FIGS. 15A-15B are charts 1500A and 1500B illustrating simulation results of an exemplary horn antenna element, according to certain aspects of the disclosure. The chart 1500A shows a plot 1502 and a plot 1504, respectively, depicting aperture efficiency as a function of frequency of a horn antenna element (e.g., 136 of FIG. 1C) for TX and RX bands. For the TX Ka band, the line 1510 shows a 1 GHz TX band, for which the aperture efficiency of plot 1502 is better than about 97%, and the broken line 1512 shows a full TX Ka band, within which the aperture efficiency of plot 1502 is better than about 90%.

For the RX Ka band, the line 1520 shows a 1 GHz TX band, for which the aperture efficiency of plot 1504 is better than about 87%, and the broken line 1522 shows a full RX Ka band, within which the aperture efficiency of plot 1504 is better than about 85%.

The chart 1500B shows a plot 1506 depicting return loss as a function of frequency of a horn antenna element (e.g., 136 of FIG. 1C) for TX and RX bands. For the TX Ka band, the return loss is better than about −23 dB for the frequencies within TX Ka band depicted by the broken line 1510. For the RX Ka band, the return loss is better than about −23 dB for the frequencies within TX Ka band depicted by the broken line 1520.

Figure 16A:
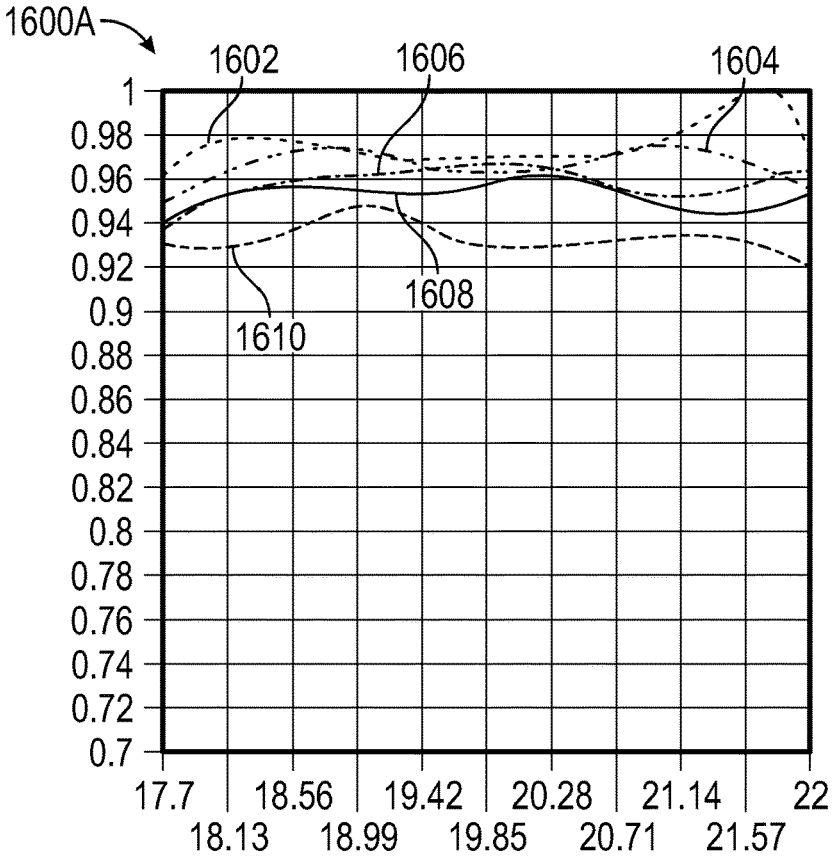
FIGS. 16A-16B are charts illustrating simulation results of an exemplary horn antenna element, according to certain aspects of the disclosure.
Figure 16B:
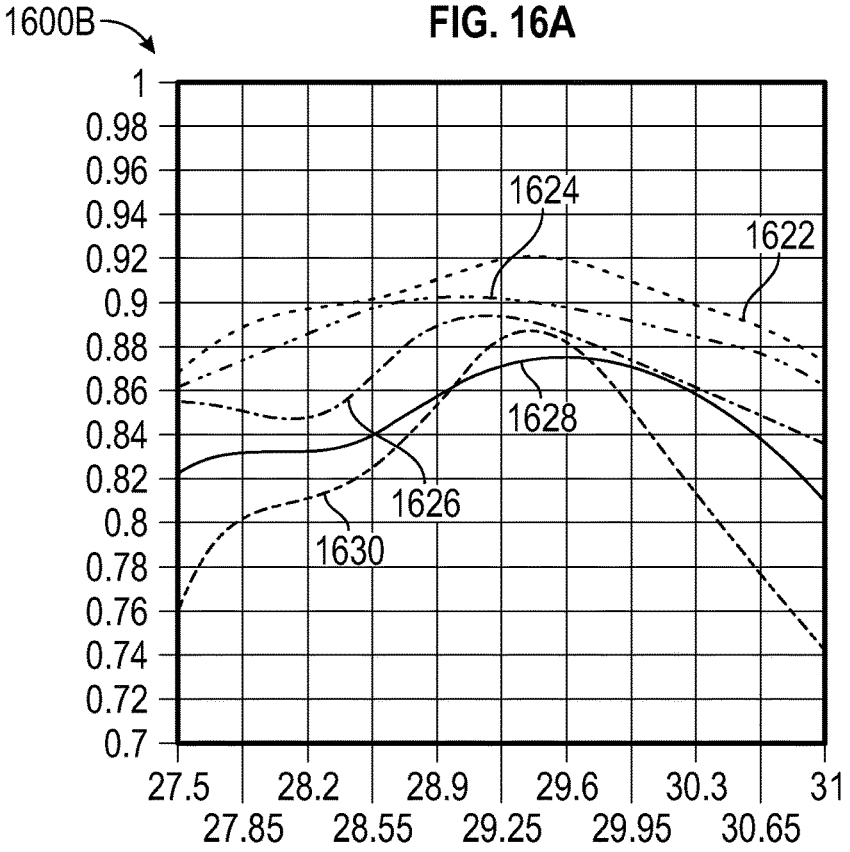

FIGS. 16A-16B are charts 1600A and 1600B illustrating simulation results of an exemplary horn antenna element, according to certain aspects of the disclosure. The chart 1600A of FIG. 16A depicts plots 1602, 1604, 1606, 1608 and 1610 showing aperture efficiency versus Ka TX frequency for five different lengths of a horn antenna element (e.g., 136 of FIG. 1C). For example, the plots 1602, 1604, 1606, 1608 and 1610 are respectively for horn antenna element lengths of 66, 61, 56, 51 and 46 mm.

The chart 1600B of FIG. 16B depicts plots 1622, 1624, 1626, 1628 and 1630 showing aperture efficiency versus Ka RX frequency for five different lengths of a horn antenna element (e.g., 136 of FIG. 1C). For example, the plots 1622, 1624, 1626, 1628 and 1630 are respectively for horn antenna element lengths of 66, 61, 56, 51 and 46 mm. The chart 1600A and 1600B show that the sweet spot for the length of the horn antenna element of the subject technology is within the range of about 56-61 mm, which is significantly lower than the length of the existing horn antennas.

Figure 17:
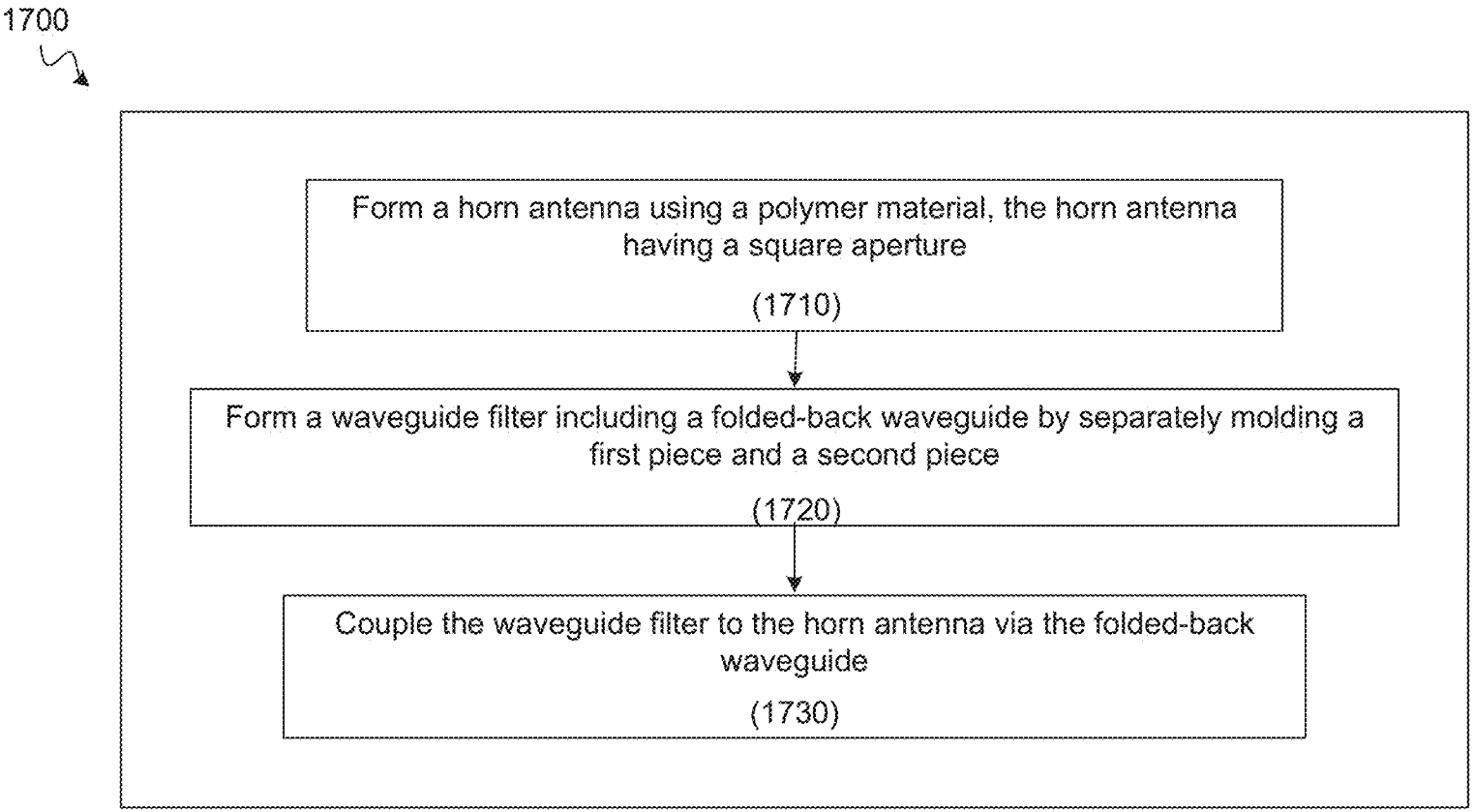
FIG. 17 is a flow diagram illustrating an example method of providing an antenna array element for a phased array, according to some aspects of the subject technology.

FIG. 17 is a flow diagram illustrating an example method 1700 of providing an antenna array element (e.g., 130 of FIG. 1B or 136 of FIG. 1C) for a phased array (e.g., 100A of FIG. 1A), according to some aspects of the subject technology. The method 1700 includes forming a horn antenna (e.g. 132 of FIG. 1B) using a polymer material, the horn antenna having a square aperture (e.g., 202 of FIG. 2A) (1710). The method 1700 further includes forming a waveguide filter (e.g., 300 of FIG. 3 or 540 of FIG. 5A) including a folded-back waveguide (e.g. 550 of FIG. 5A) by separately molding a first piece (e.g., 402 of FIG. 4) and a second piece (e.g., 410 of FIG. 4) (1720). The waveguide filter is coupled to the horn antenna via the folded-back waveguide (1730). The first footprint of the waveguide filter (e.g., the width of 140 of FIG. 1B) is within a second footprint of an aperture (e.g., 135 of FIG. 1B) of the horn antenna.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order, or partitioned in a different way) all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Any of the blocks may be performed simultaneously. In one or more implementations, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

As used in this specification and any claims of this application, the terms "base station", "receiver", "computer", "server", "processor", and "memory" all refer to electronic or other technological devices. These terms exclude people or groups of people. For the purposes of the specification, the terms "display" or "displaying" means displaying on an electronic device.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range are specifically disclosed. Also, the terms in the claims have their plain, ordinary meaning unless otherwise explicitly and clearly defined by the patentee. If there is any conflict in the usages of a word or term in this specification and one or more patent or other documents that may be incorporated herein by reference, the definitions that are consistent with this specification should be adopted.

What is claimed is:

1. An antenna array comprising:

a plurality of array modules, an array module of the plurality of array modules comprising at least one antenna element including:

a horn antenna coupled to a polarizer; and a two-piece waveguide filter including a folded-back waveguide coupled to the horn antenna at one end and to a circuit layer at another end, wherein:

the horn antenna comprises a multi-mode horn antenna, the two-piece waveguide filter comprises a first piece and a second piece separately molded, and a first footprint of the two-piece waveguide filter is within a second footprint of an aperture of the horn antenna.

2. The antenna array of claim 1, wherein the multi-mode horn antenna comprises one of a square multi-mode horn antenna or a hexagonal multi-mode horn antenna.

3. The antenna array of claim 1, wherein the antenna element is a high aperture efficiency antenna element having aperture efficiency better than about 90%.

4. The antenna array of claim 1, wherein the antenna element is a low return loss antenna element having a return loss lower than about −25 dB within a Ku band.

5. The antenna array of claim 1, wherein the two-piece waveguide filter comprises a substantially rectangular waveguide, and wherein a split line of the first piece and the second piece substantially runs through a middle of an H-plane wall where no electric current crosses.

6. The antenna array of claim 1, wherein the two-piece waveguide filter comprises a Ka-band diplexer with a transmit (TX) band center frequency of about 20 GHz and a receive (RX) band center frequency of about 30 GHz.

7. The antenna array of claim 6, wherein an aperture efficiency of the antenna element is better than about 98% in a first 1-GHz bandwidth within the TX band, and better than about 87% in a second 1-GHz bandwidth within the RX band.

8. The antenna array of claim 6, wherein a return loss of the antenna element is less than about −23 dB within the TX band, and less than about −25 dB within the RX band.

9. The antenna array of claim 1, wherein the polarizer comprises one of a waveguide polarizer or a planar polarizer, and wherein the planar polarizer is a meanderline polarizer that comprises a multilayer polarizer, and wherein each layer of the multilayer polarizer comprises a kapton film substrate and surface layer strip meanders.

10. The antenna array of claim 1, wherein the first piece and the second piece comprise one of molded glass filled polymer or a polymer coated with an electrically-conductive layer.

11. A method of providing an antenna array element for a phased array, the method comprising:

forming a horn antenna using a polymer material, the horn antenna having a square;

forming a waveguide filter including a folded-back waveguide by separately molding a first piece and a second piece; and coupling the waveguide filter to the horn antenna via the folded-back waveguide, wherein a first footprint of the waveguide filter is within a second footprint of an aperture of the horn antenna.

12. The method of claim 11, wherein forming the horn antenna comprises a forming a multi-mode horn antenna, and wherein the polymer material is coated with an electrically-conductive layer.

13. The method of claim 11, wherein separately molding the first and the second piece comprise using a polymer, and wherein the method further comprises bonding the first piece to the second piece using a silver filed epoxy.

14. The method of claim 13, further comprising coating the horn antenna and the waveguide filter using multiple metal layers and an anti-corrosion finish layer.

15. The method of claim 11, further comprising:

forming a multilayer polarizer by forming each polarizer layer by forming surface layer strip meanders on a kapton film substrate and coupling polarizer layers using foam spacers; and coupling the multilayer polarizer to the antenna array element.

16. The method of claim 11, wherein forming the waveguide filter comprises framing a substantially rectangular waveguide, and wherein a split line of the first piece and the second piece runs through a middle of an H-plane wall of the waveguide filter where no electric current crosses.

17. The method of claim 11, further comprising coupling the waveguide filter to a stripline feed of a multi-layer board (MLB) using a feed probe.

18. An apparatus comprising:

a plurality of subarrays, each of the plurality of subarrays comprising a plurality of array modules, each array module comprising a plurality of array elements including:

a horn antenna having a square aperture; and a waveguide filter including a first piece and a second piece, the first piece and the second piece being separately molded, and the first piece including a folded-back waveguide, wherein:

the folded-back waveguide is a 90-degree fold-back waveguide and is coupled to the horn antenna, and a first footprint of the waveguide filter is within a second footprint of an aperture of the horn antenna.

19. The apparatus of claim 18, wherein the horn antenna comprises a multi-mode horn antenna, wherein the waveguide filter is coupled to a stripline feed of a multi-layer board (MLB) using a feed probe.

20. The apparatus of claim 18, wherein the waveguide filter comprises a substantially rectangular waveguide, and wherein a split line of the first piece and the second piece runs through a middle of an H-plane wall of the waveguide filter where no electric current crosses.

* * * * *